US011008972B2

(12) United States Patent
Stanley et al.

(10) Patent No.: US 11,008,972 B2
(45) Date of Patent: May 18, 2021

(54) SYSTEMS AND METHODS FOR AVOIDING STRUCTURAL FAILURE RESULTING FROM HOT HIGH CYCLES USING A CYLINDER HEAD COOLING ARRANGEMENT

(71) Applicant: CUMMINS INC., Columbus, IN (US)

(72) Inventors: Michael T. Stanley, Columbus, IN (US); Jason R. Griffin, Greenwood, IN (US); Timothy C. Ernst, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 16/333,298

(22) PCT Filed: Sep. 7, 2017

(86) PCT No.: PCT/US2017/050507
§ 371 (c)(1),
(2) Date: Mar. 14, 2019

(87) PCT Pub. No.: WO2018/057305
PCT Pub. Date: Mar. 29, 2018

(65) Prior Publication Data

US 2019/0242327 A1 Aug. 8, 2019

Related U.S. Application Data

(60) Provisional application No. 62/397,002, filed on Sep. 20, 2016.

(51) Int. Cl.
*F02F 1/40* (2006.01)
*F02F 1/24* (2006.01)

(52) U.S. Cl.
CPC ..... *F02F 1/40* (2013.01); *F02F 1/242* (2013.01)

(58) Field of Classification Search
CPC ..... F02F 1/40; F02F 1/242; F02F 1/38; F02F 1/36; F01P 3/16; F01P 3/02; F01P 2003/024; F01P 3/14; F01P 1/10
(Continued)

(56) References Cited

U.S. PATENT DOCUMENTS 3,074,389 A * 1/1963 Lilly ..... F02F 1/40 123/41.73
3,081,755 A * 3/1963 Kotlin ..... F02F 1/26 123/41.77

(Continued)

FOREIGN PATENT DOCUMENTS

CN 102822489 12/2012
CN 103939227 7/2014

(Continued)

OTHER PUBLICATIONS

KR 20140128518 English Translation.*

(Continued)

*Primary Examiner* — George C Jin
*Assistant Examiner* — Teuta B Holbrook
(74) *Attorney, Agent, or Firm* — Foley & Lardner LLP

(57) ABSTRACT

A system for cooling a cylinder head includes a cylinder head, a cylinder block, and a waste heat recovery system. The cylinder head includes a first water jacket and a second water jacket. The cylinder block is coupled to the cylinder head. The cylinder block includes a third water jacket. The first water jacket is coupled to a first cooling circuit. The second water jacket is coupled to a second cooling circuit. The third water jacket is coupled to a third cooling circuit. The waste heat recovery system is coupled to at least one of the first cooling circuit, the second cooling circuit, and the third cooling circuit.

11 Claims, 20 Drawing Sheets

(58) Field of Classification Search
USPC ..... 123/41.72, 41.82 R, 41.44
See application file for complete search history.

(56) References Cited

U.S. PATENT DOCUMENTS

| | | | | | |
|---|---|---|---|---|---|
| 3,889,644 | A * | 6/1975 | Moore | F02F 1/38 | 123/41.77 |
| 4,955,335 | A | 9/1990 | Jingu et al. | | |
| 5,765,282 | A * | 6/1998 | Sweetland | F02F 1/4214 | 29/888.06 |
| 5,983,843 | A * | 11/1999 | Suzuki | F02F 1/4214 | 123/41.82 R |
| 8,397,682 | B2 | 3/2013 | Hamada | | |
| 8,707,914 | B2 * | 4/2014 | Barnes | F01P 3/2285 | 123/41.2 |
| 2002/0129776 | A1 * | 9/2002 | Krenn | F02F 1/40 | 123/41.82 R |
| 2005/0150477 | A1 * | 7/2005 | Rieger | F02F 11/002 | 123/193.5 |
| 2010/0089343 | A1 * | 4/2010 | Hamada | F01P 3/02 | 123/41.74 |
| 2011/0277708 | A1 | 11/2011 | Geiser et al. | | |
| 2012/0073528 | A1 | 3/2012 | Kim et al. | | |
| 2012/0138007 | A1 | 6/2012 | Smith et al. | | |
| 2012/0240883 | A1 * | 9/2012 | Mcgiffin | F02F 1/166 | 123/41.72 |
| 2013/0055971 | A1 | 3/2013 | Brewer et al. | | |
| 2014/0202143 | A1 * | 7/2014 | Tabuchi | F02F 1/243 | 60/323 |
| 2015/0211408 | A1 * | 7/2015 | Maier | F02F 1/38 | 123/41.77 |
| 2016/0186641 | A1 * | 6/2016 | Ogino | F02F 1/38 | 123/41.74 |
| 2017/0051713 | A1 | 2/2017 | Peters et al. | | |

FOREIGN PATENT DOCUMENTS

| | | | | |
|---|---|---|---|---|
| CN | 103967581 | | 8/2014 | |
| CN | 105370370 | | 3/2016 | |
| CN | 105822450 | | 8/2016 | |
| EP | 206125 | A * | 12/1986 | |
| EP | 0 735 244 | A | 10/1996 | |
| JP | 9032630 | | 2/1997 | |
| JP | 09324695 | A * | 12/1997 | F02F 1/40 |
| JP | 2000008945 | A * | 1/2000 | F02F 1/40 |
| KR | 20140128518 | A * | 11/2014 | |
| WO | WO-2005088111 | A1 * | 9/2005 | F01P 3/14 |

OTHER PUBLICATIONS

International Search Report and Written Opinion from corresponding PCT Application No. PCT/US2017/050507, dated Jan. 11, 2018, pp. 1-10.

Office Action from CN Application No. 2017800579656, dated Jul. 2, 2020.

Office Action for CN Application No. 2017800579656, dated Jan. 14, 2021.

* cited by examiner

SYSTEMS AND METHODS FOR AVOIDING STRUCTURAL FAILURE RESULTING FROM HOT HIGH CYCLES USING A CYLINDER HEAD COOLING ARRANGEMENT

CROSS-REFERENCE TO RELATED APPLICATIONS

The present application is the U.S. national phase of PCT Application No. PCT/US2017/050507, filed Sep. 7, 2017, which claims priority to U.S. Provisional Patent Application No. 62/397,002, filed on Sep. 20, 2016, the contents of which are incorporated herein by reference in their entireties and for all purposes.

TECHNICAL FIELD

The present disclosure relates to the field of internal combustion engines. More specifically, the present disclosure relates to a system and method for avoiding structural failure resulting from hot high cycles using a cylinder head cooling arrangement.

BACKGROUND

Internal combustion engines typically include cooling systems that route coolant through a cylinder head of the internal combustion engine. In some applications, the coolant is routed near fuel injectors in the cylinder head. A cylinder head configuration (i.e., the cylinder head and cooling system combination) may be designed to minimize stresses that result on the cylinder head from externally applied loads such as loads that occur during assembly as well as loads from pressure that occur during operation of the internal combustion engine. The cylinder head configuration also typically takes into account temperature on a combustion face of the cylinder head. Temperatures on the combustion face may be associated with stresses on the cylinder head that result from thermal growth.

Conventionally, cooling systems include a single cooling circuit that provides cooling to both the cylinder head and the cylinder block. As a result, conventional cooling systems are unable to optimally meet cooling requirements of the cylinder head and the cylinder block. This is of particular importance when the internal combustion engine includes a waste heat recovery system. Because the conventional cooling systems cannot optimally meet the cooling requirements of the internal combustion engine, the waste heat recovery system cannot efficiently harvest energy from the cooling system.

SUMMARY

One embodiment relates to a system for cooling a cylinder head. The system includes a cylinder head, a cylinder block, and a waste heat recovery system. The cylinder head includes a first water jacket and a second water jacket. The cylinder block is coupled to the cylinder head. The cylinder head includes a third water jacket. The first water jacket is coupled to a first cooling circuit. The second water jacket is coupled to a second cooling circuit. The third water jacket is coupled to a third cooling circuit. The waste heat recovery system is coupled to at least one of the first cooling circuit, the second cooling circuit, and the third cooling circuit.

Another embodiment is related to a cylinder head. The cylinder head includes an upper water jacket, a lower water jacket, a drilled bridge passage, and a drilled water jacket connector. The drilled valve bridge passage is coupled to the lower water jacket. The drilled water jacket connector is coupled to the upper water jacket and the drilled valve bridge passage such that the upper water jacket is coupled to the lower water jacket through the drilled valve bridge passage and the drilled water jacket connector. The drilled valve bridge passage extends into the cylinder head beyond the drilled water jacket connector. The upper water jacket and the lower water jacket are contained within the cylinder head.

Another embodiment relates to a method of manufacturing a cylinder head. A cast cylinder head is provided. The cast cylinder head includes a combustion face and a top face opposite the combustion face. The cast cylinder head also includes a first lateral face and a second lateral face opposite the first lateral face. The cast cylinder head further includes an upper water jacket, a lower water jacket, and an injector bore extending from the top face to the combustion face along a first central axis. A first bore is drilled into the cylinder head from the cylinder head face through the upper water jacket so as to define a water jacket connector. A second bore is drilled into the cylinder head from the first lateral face, through the lower water jacket, and into the first bore so as to define a valve bridge passage.

BRIEF DESCRIPTION OF THE DRAWINGS

The details of one or more implementations are set forth in the accompanying drawings and the description below. Other features, aspects, and advantages of the disclosure will become apparent from the description, the drawings, and the claims.

Figure 1:
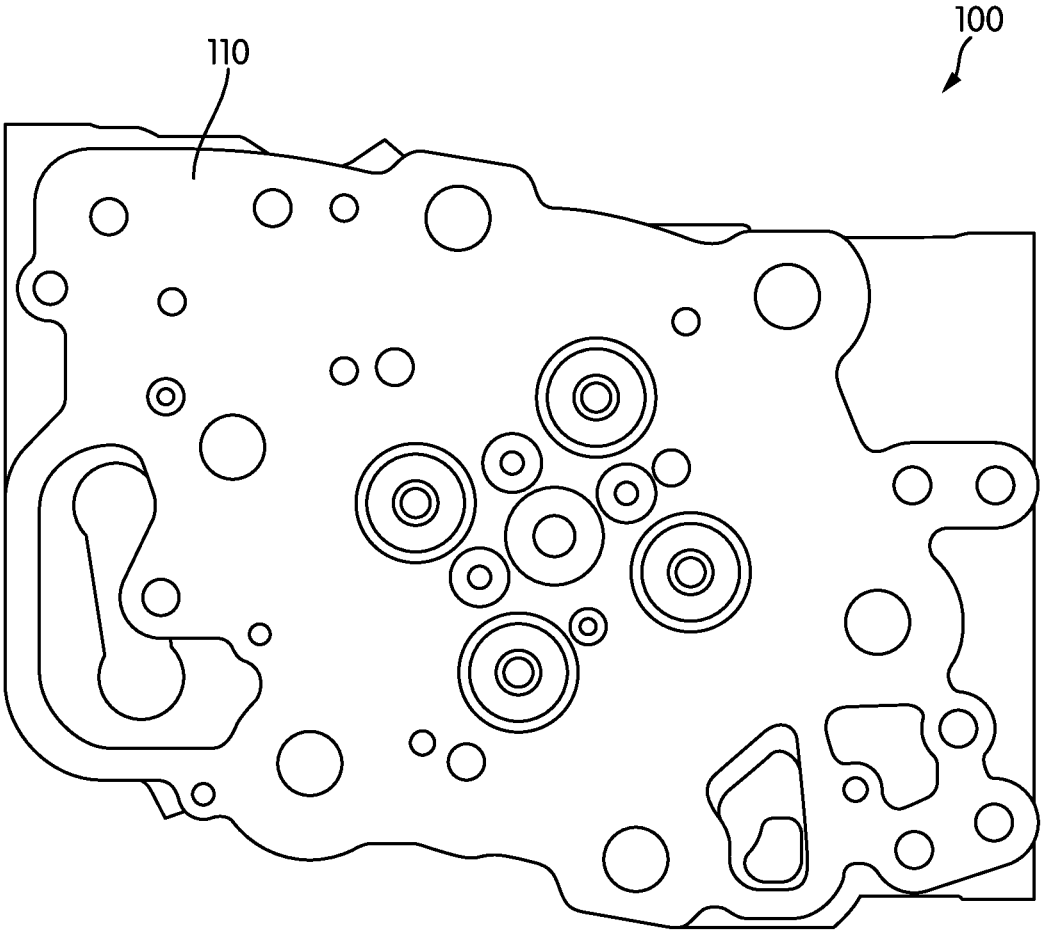
FIG. 1 is a top view of a cylinder head cooling arrangement, according to an exemplary embodiment.

It will be recognized that the figures are representations for purposes of illustration. The figures are provided for the purpose of illustrating one or more implementations with the explicit understanding that they will not be used to limit the scope or the meaning of the claims.

DETAILED DESCRIPTION

In the following detailed description, reference is made to the accompanying drawings, which form a part thereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

Cylinder head and cylinder block cooling systems operate to ensure that temperatures of the cylinder head, the cylinder block, and other vehicle components do not exceed rated operating temperature limits. Conventional cooling systems typically route coolant through the cylinder head and the cylinder block. Typically, conventional cooling systems utilize a single, common circuit for circulation of the coolant. As a result, portions of the cylinder head and the cylinder block may not receive optimal cooling.

Conventional cylinder head configurations typically include a cooling system that includes an upper water jacket (UWJ), a lower water jacket (LWJ), and a passage between the upper water jacket and the lower water jacket. In operation, the cooling fluid is typically routed through the coolant system from the lower water jacket through the passage and into the upper water jacket. In conventional applications, the upper water jacket, the lower water jacket, and the passage are all formed via a casting process. As a result, the design of the upper water jacket, the lower water jacket, and the passage are limited (e.g., limited in various dimensions, limited in orientations, etc.). For example, casting of longer and/or thinner passages gives rise to the risk of core breakage during the casting process and difficulty in clearing out core sand from the finished product. In other applications, cooling fluid is routed in an area proximate the fuel injector such that the cooling fluid is not in direct contact with the fuel injector. In some cases, the internal combustion engine may perform undesirably due to the cylinder head configuration. For example, the cylinder head configuration may not provide adequate cooling to the cylinder head thereby resulting in undesirable structural changes to the cylinder head.

Referring generally to the figures, various embodiments relate to a cylinder head cooling arrangement for cooling components of an internal combustion engine. The cylinder head cooling arrangement is structured to cool both a cylinder head and a cylinder block of the internal combustion engine. The cylinder head cooling arrangement includes a cylinder head. The cylinder head includes an upper water jacket, a lower jacket, a valve bridge passage, and a water jacket connector. The valve bridge passage and the water jacket connector are formed by a drilling process in the cylinder head. The upper water jacket and the lower water jacket are contained within the cylinder head (i.e., the upper water jacket and the lower water jacket do not extend into the cylinder block). The upper water jacket and the lower water jacket are structured to individually receive a coolant thereby belonging to two separate cooling circuits. In this way, the cylinder head has improved durability over a conventionally formed cylinder head.

The cylinder head is mounted to a cylinder block including a water jacket. The cylinder block water jacket is structured to receive a coolant and belong to another separate cooling circuit. The cylinder head and cylinder block are coupled to a waste heat recovery system. In some embodiments, the waste heat recovery system receives circulated coolant from any of the cooling circuits.

Depending on the configuration of the cylinder head and the cylinder block, certain locations may require more cooling than other locations. Through the use of the cylinder head, cylinder block, and the waste heat recovery system, these locations are cooled by at least one of the circuits such that efficiency and desirability of the internal combustion engine is increased. In some embodiments, each of the separate cooling loops is tasked with providing a different level of cooling to the internal combustion engine. Further, the level of cooling provided by the separate cooling loops can be varied such that these locations can be dynamically cooled as a function of time (e.g., time from start, etc.). Some embodiments facilitate reduced fluid (e.g., combustion fuel, diesel exhaust fluid (DEF), etc.) consumption, reduced emissions, reduced oil consumption, and reduced combustion blow-by. Other embodiments facilitate fast warm-up time of the internal combustion engine and reduced cooling system pumping power. The cylinder head cooling arrangement can also be used to facilitate thermal management of exhaust aftertreatment. The cylinder head cooling arrangement facilitates more efficient and effective thermal management of a cylinder head and/or cylinder block of an internal combustion engine due, in part, to the ability to control individual cooling circuits corresponding with different locations of the cylinder head and/or cylinder block.

FIGS. 1-13 illustrate various cross-sectional views of a cylinder head cooling arrangement 100, according to an embodiment. In particular, FIG. 1 is a top view of the cylinder head cooling arrangement 100, according to an embodiment. According to various embodiments, the cylinder head cooling arrangement 100 is implemented in an internal combustion engine. For example, the cylinder head cooling arrangement 100 may be implemented in a diesel engine, a gasoline engine, a natural gas engine, a propane engine, a forced induction engine, a naturally aspirated engine, and other similar devices. In some embodiments, the cylinder head cooling arrangement 100 is implemented in a vehicular system (e.g., for an automobile, for a truck, for a commercial vehicle, for an emergency vehicle, for a construction vehicle, etc.).

The cylinder head cooling arrangement 100 includes a cylinder head 110. The cylinder head 110 is structured to be coupled to the internal combustion engine. In some embodiments, the cylinder head 110 is formed via a casting process. In other embodiments, the cylinder head is formed via a milling, machining, forging, or other similar process. The cylinder head 110 may be subjected to various machining and finishing processes such as drilling, honing, and tapping.

As described herein, the cylinder head cooling arrangement 100 is structured to circulate a coolant. Depending on the application, different coolants may be circulated. For example, the cylinder head cooling arrangement 100 may circulate water, glycol, oil, antifreeze, inorganic acid technology coolants, organic acid technology coolants, hybrid organic technology coolants, and other similar coolants.

Figure 2:
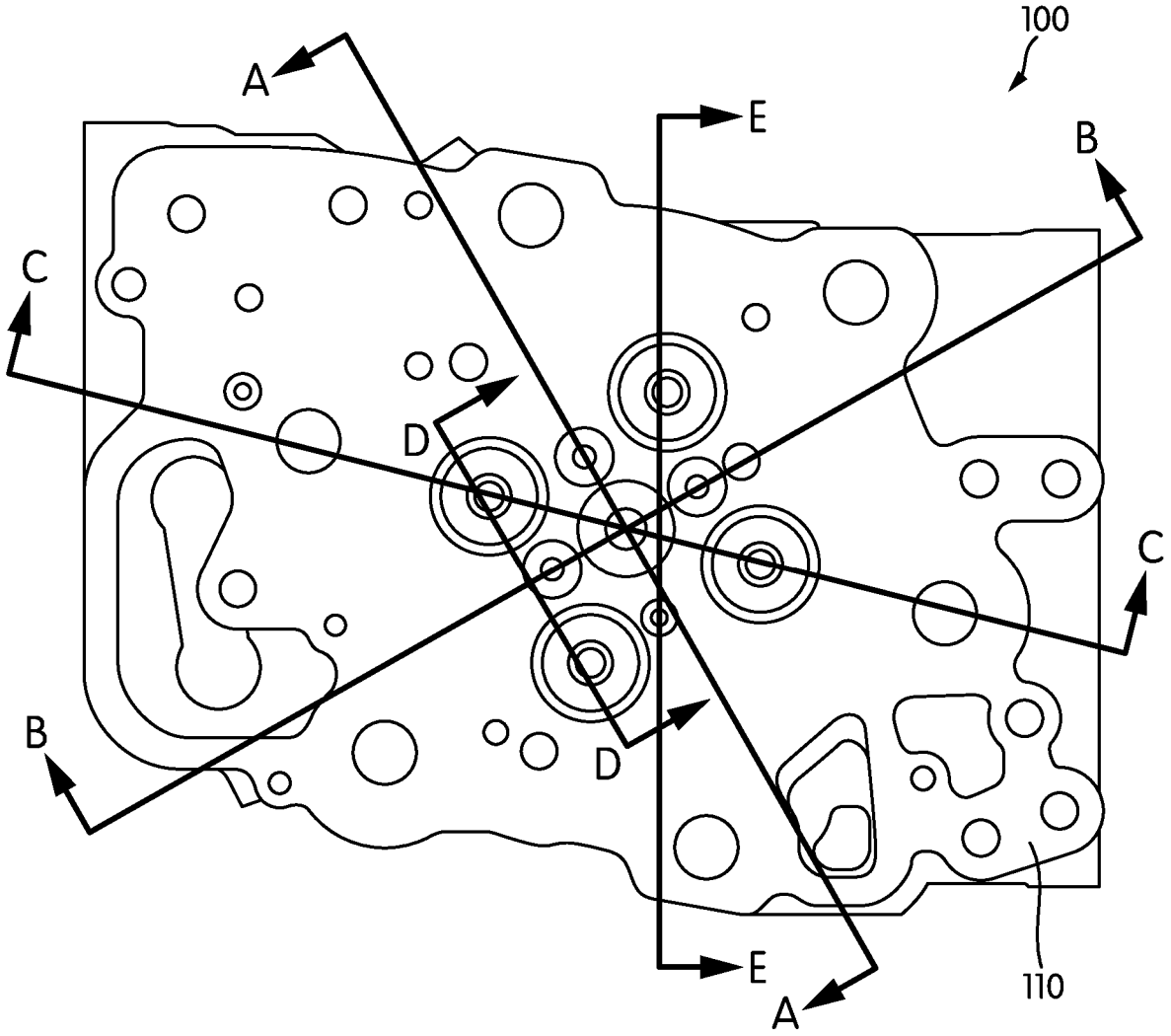
FIG. 2 is a labeled view of the cylinder head cooling arrangement shown in FIG. 1.
Figure 3:
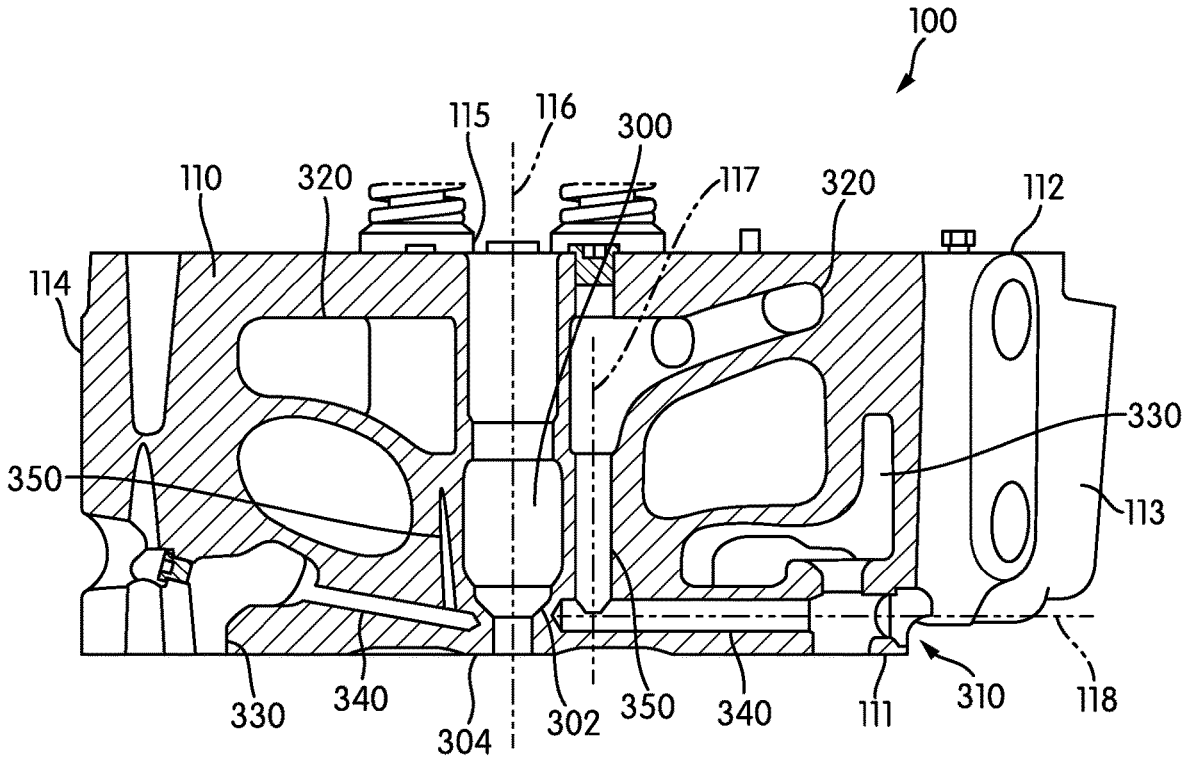
FIG. 3 is a side cross-sectional view of the cylinder head cooling arrangement shown in FIGS. 1 and 2 along line A-A.
Figure 4:
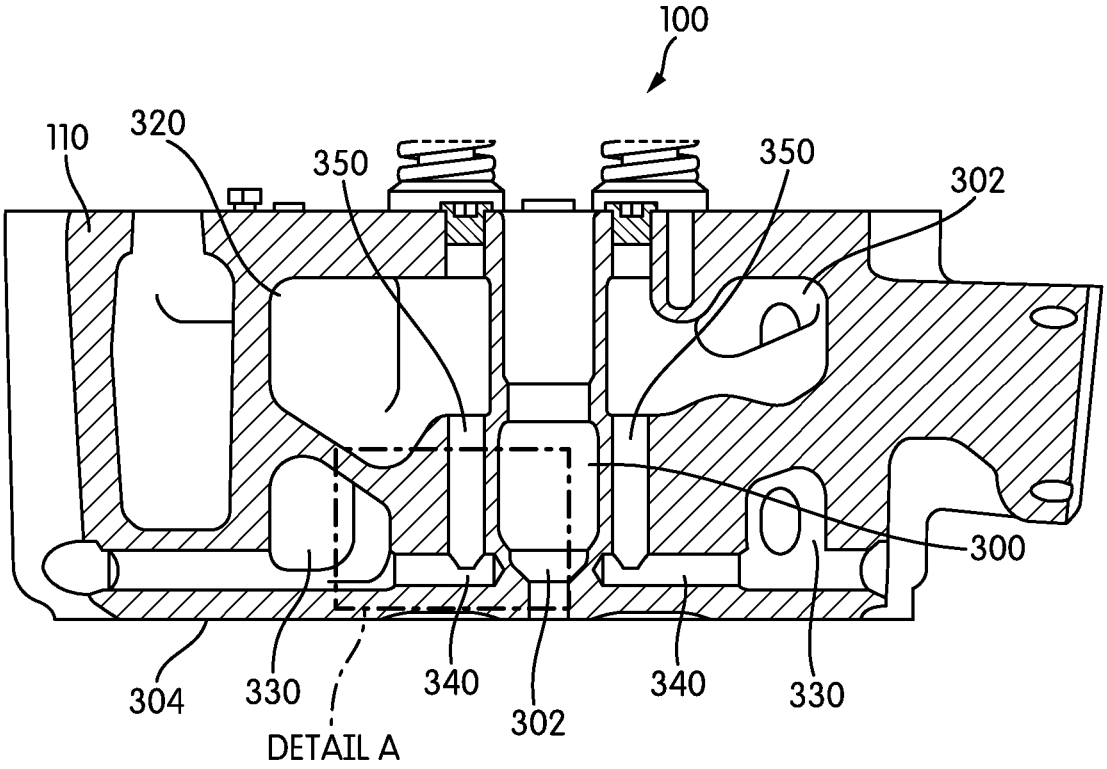
FIG. 4 is a side cross-sectional view of the cylinder head cooling arrangement shown in FIGS. 1 and 2 along line B-B.
Figure 6:
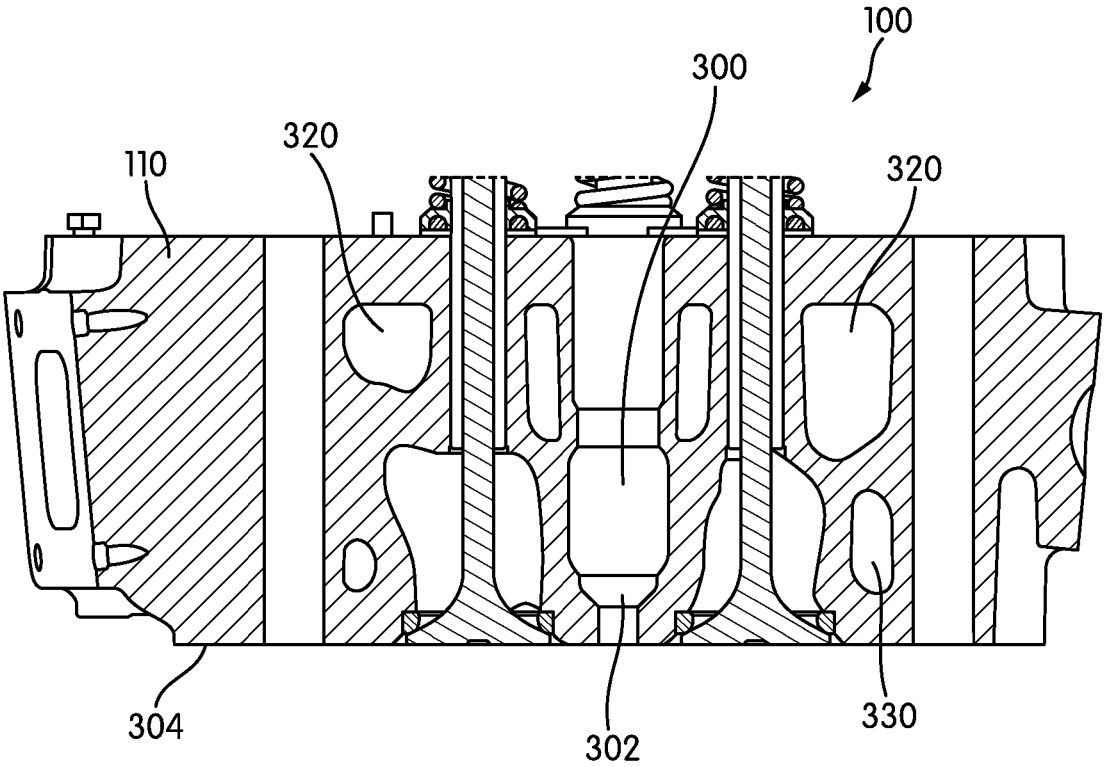
FIG. 6 is a side cross-sectional view of the cylinder head cooling arrangement shown in FIGS. 1 and 2 along line C-C.
Figure 7:
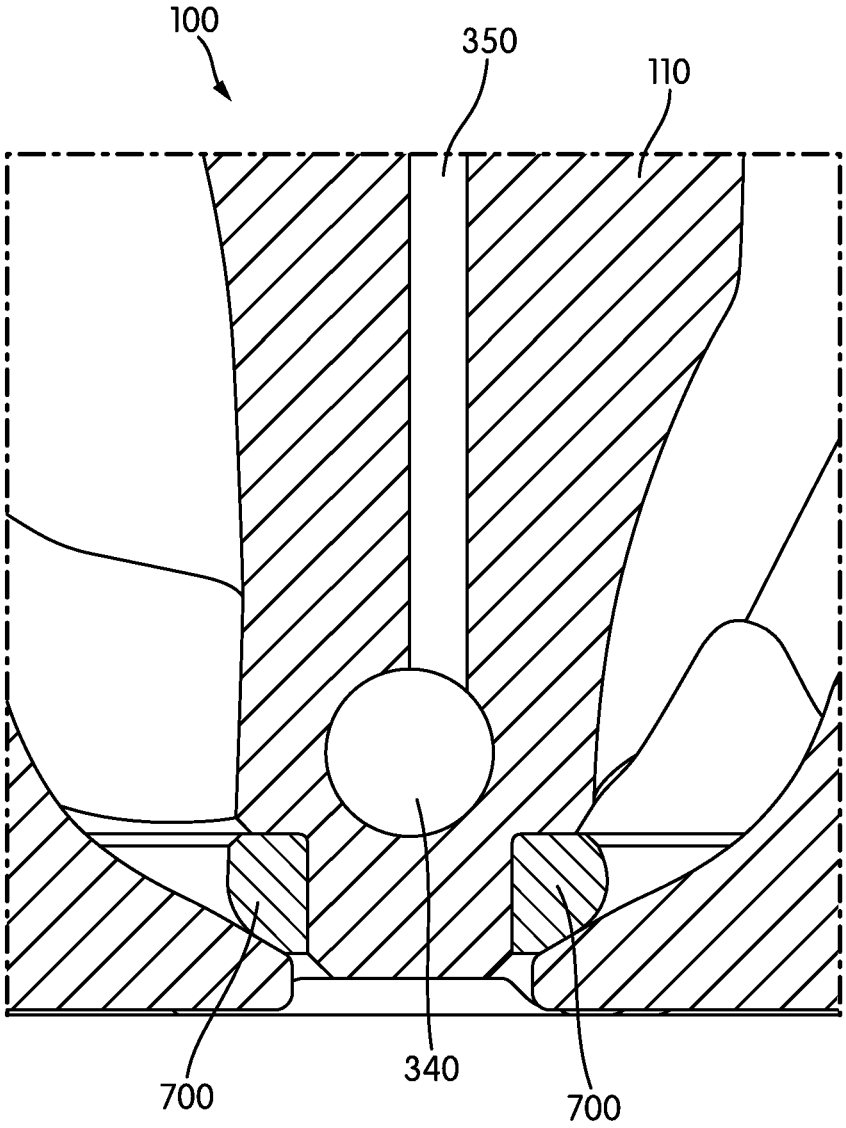
FIG. 7 is a side cross-sectional view of the cylinder head cooling arrangement shown in FIGS. 1 and 2 along line D-D.
Figure 8:
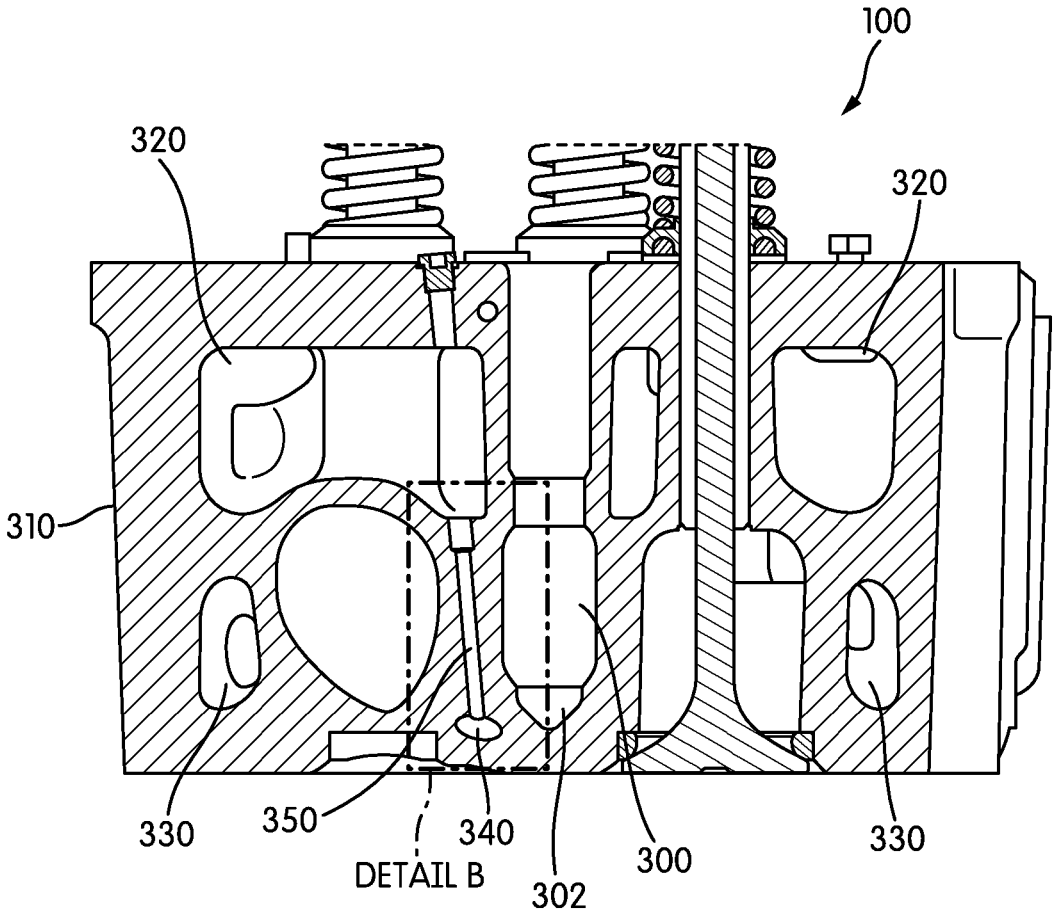
FIG. 8 is a side cross-sectional view of the cylinder head cooling arrangement shown in FIGS. 1 and 2 along line E-E.
Figure 9:
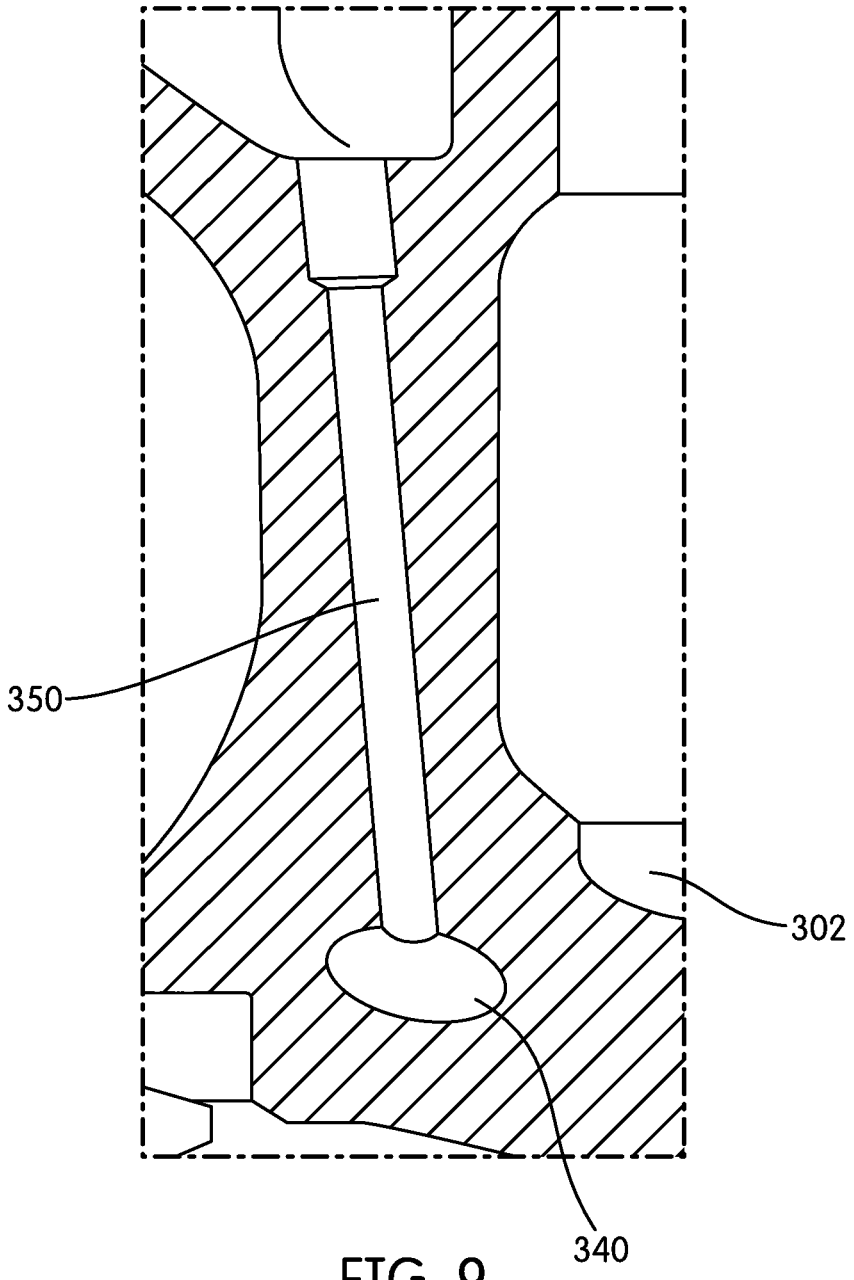
FIG. 9 is a detailed view of DETAIL B of the cross-sectional view of the cylinder head cooling arrangement shown in FIG. 8.

FIG. 2 is a labeled view indicating various section lines of the cylinder head cooling arrangement 100 of FIG. 1. The section lines are referenced below in connection with various cross-sectional views of the cylinder head cooling arrangement 100. In particular, FIG. 3 is a side cross-sectional view of the cylinder head cooling arrangement 100 along section line A-A as shown in FIG. 2. FIG. 4 is a side cross-sectional view of the cylinder head cooling arrangement 100 along section line B-B as shown in FIG. 2. FIG. 6 is a side cross-sectional view of the cylinder head cooling arrangement 100 along section line C-C as shown in FIG. 2. FIG. 7 is a side cross-sectional view of the cylinder head cooling arrangement 100 along section line D-D as shown in FIG. 2. FIG. 8 is a side cross-sectional view of the cylinder head cooling arrangement 100 along section line E-E as shown in FIG. 2.

As illustrated in FIGS. 3-8, the cylinder head 110 defines a combustion face 111, a top face 112 opposite the combustion face 111, a first lateral face 113, and a second lateral face 114 opposite the first lateral face 113. In operation, the combustion face 111 abuts a cylinder block of an engine. The cylinder head 110 also defines an injector bore 115 extending from the top face 112 to the combustion face 111 along a first central axis 116. In some embodiments, the injector bore 115 is formed when casting the cylinder head 110. The injector bore 115 may also be finished by machining the cast injector bore 115. In other embodiments, the injector bore 115 is not cast when casting the cylinder head 110, but is instead fully machined into the cast cylinder head 110.

The cylinder head cooling arrangement 100 includes a fuel injector 300 positioned in the injector bore 115. It should be understood that the fuel injector 300 is not shown in the figures. Rather, the fuel injector 300 refers to a position of a fuel injector within the injector bore 115. The fuel injector 300 is structured to receive a fuel (e.g., diesel, gasoline, petrol, octane, etc.) or fuel mixture and provide the fuel or fuel mixture to the internal combustion engine. The fuel injector 300 includes a fuel injector seat 302. According to various embodiments, the cylinder head cooling arrangement 100 is structured to provide cooling to the fuel injector 300 through the use of a cooling system 310. The cooling system 310 is structured to receive coolant and to route the coolant through the cylinder head 110. According to various embodiments, the cooling system 310 routes coolant towards a combustion face 304 of the cylinder head 110.

In an exemplary embodiment, the cooling system 310 includes an upper water jacket 320, a lower water jacket 330, valve bridge passages 340, and water jacket connectors 350. The valve bridge passages 340 and the water jacket connectors 350 fluidly couple the upper and lower water jackets 320, 330. More specifically, the water jacket connector 350 is fluidly coupled to each of the upper water jacket 320 and the valve bridge passage 340, and the valve bridge passage 340 is fluidly coupled to each of the water jacket connector 350 and the lower water jacket 330. Some embodiments include a plurality of upper and lower water jackets 320, 330. In such embodiments, the cooling system 310 includes a plurality of the valve bridge passages 340 and water jacket connectors 350, with each pair of the valve bridge passages 340 and water jacket connectors 350 fluidly coupling a respective pair of the upper and lower water jackets 320, 330. According to an exemplary operation, the cooling system 310 functions by transmitting coolant from the lower water jackets 330, through the valve bridge passages 340, through the water jacket connectors 350, and into the upper water jackets 320. The upper water jackets 320 are structured such that the upper water jackets 320 are disposed a greater distance from the lower water jackets 330 than upper water jackets are from lower water jackets in a conventional cylinder head. According to various embodiments, the centers of the upper water jackets 320 are disposed above the water jacket connectors 350. In other words, the upper water jackets 320 are positioned closer to the top face 112 of the cylinder head 110 than the water jacket connectors 350. In some embodiments, the water jacket connectors 350 extend along a second central axis 117 parallel with the first central axis 116. In some embodiments, the valve bridge passages 340 extend along a third central axis 118. The third central axis 118 is perpendicular to the first and second central axes 116, 117. Although the first, second, and third central axes 116, 117, 118 are described as being parallel or perpendicular relative to each other, it should be understood that the respective first, second, and third central axes 116, 117, 118 may vary by ±10 degrees relative to being precisely parallel or perpendicular to one another. In other embodiments, at least one of the first, second, and third central axes 116, 117, 118 is not perpendicular or parallel to the others.

Depending on the configuration of the cylinder head cooling arrangement 100, any of the upper water jackets 320 and the lower water jackets 330 may extend from the cylinder head 110 and into to a jacket in the cylinder block. However, in some embodiments, the upper water jackets 320 and the lower water jackets 330 do not extend into the cylinder block and are rather contained within the cylinder head 110 and are not coupled to a jacket in the cylinder block. By having the upper water jackets 320 and the lower water jackets 330 contained within the cylinder head 110 and not coupled to a jacket in the cylinder block, fewer leak points exist where coolant may unintentionally and undesirably exit the cooling system 310. Further, by having the upper water jackets 320 and the lower water jackets 330 contained within the cylinder head 110 and not coupled to a jacket in the cylinder block, less machining of the cylinder block may be needed, thereby reducing manufacturing costs of the internal combustion engine.

Still further, by having the upper water jackets 320 and the lower water jackets 330 contained within the cylinder head 110 and not coupled to a jacket in the cylinder block, different and complete upper water jackets 320 and lower water jackets 330 may be interchangeably coupled to the cylinder block allowing for greater flexibility and modularity of the internal combustion engine to be tailored for a desired application. In contrast, if the upper water jackets and the lower water jackets extend from the cylinder head into the cylinder block, as is the case in a conventional internal combustion engine, the entire upper water jackets and lower water jackets cannot be interchanged without interchanging both the cylinder head and cylinder block. Thus, the process of interchanging the conventional internal combustion engine may be more expensive and less desirable than the process of interchanging the cylinder head cooling arrangement 100. In some embodiments, the upper water jacket 320 and the lower water jacket 330 are located further from an interface between the cylinder head 110 and the cylinder block than similar structures in a conventional cylinder head.

In some alternative embodiments, the upper water jackets 320 are contained within the cylinder head 110 and not coupled to a jacket in the cylinder block, and the lower water jackets 330 are only partially contained in the cylinder head 110. In other embodiments, the lower water jackets 330 are contained within the cylinder head 110 and not coupled to a jacket in the cylinder block, and the upper water jackets 320 are only partially contained in the cylinder head 110. In still other embodiments, any of the upper water jackets 320 and the lower water jackets 330 extends from the cylinder head 110 without extending into the cylinder block and without coupling with a jacket in the cylinder block. For example, any of the upper water jackets 320 and the lower water jackets 330 may extend from the cylinder head 110 into a valve cover.

According to various embodiments, the valve bridge passages 340 and the water jacket connectors 350 are formed through a drilling process rather than through a casting process (e.g., core removal). By forming the valve bridge passages 340 and/or the water jacket connectors 350 through a drilling process, manufacturing issues (e.g., core breaking, sand left in the cylinder head 110, dimensional constraints, orientation constraints, etc.) that arise due to the use of a casting core are avoided. Thus, the valve bridge passages 340 and/or the water jacket connectors 350 may be longer in length than similar structures in a conventional cylinder head. Further, when the valve bridge passages 340 and/or the water jacket connectors 350 are drilled, portions of the cylinder head 110 may be thicker and more robust than in a conventional cylinder head when similar structures are cast into a conventional cylinder head. Additionally, dimensional tolerances of the valve bridge passages 340 and the water jacket connectors 350 are smaller than of similar structures in a conventional cylinder head.

Figure 5:
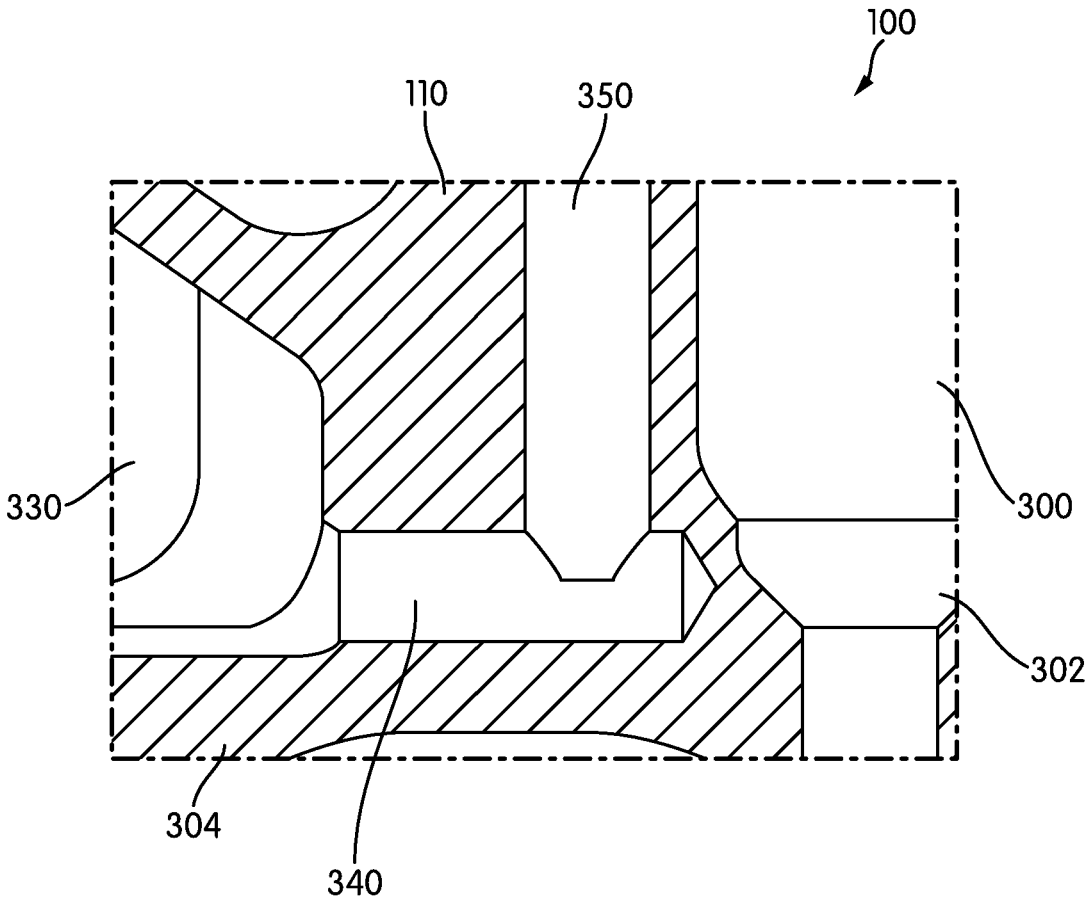
FIG. 5 is a detailed view of DETAIL A of the cross-sectional view of the cylinder head cooling arrangement shown in FIG. 4.

FIG. 5 is a detailed view of DETAIL A of the cross-sectional view of the cylinder head cooling arrangement shown in FIG. 4. The smaller dimensional tolerances allow the valve bridge passages 340 and the water jacket connectors 350 to deliver coolant closer to portions that require cooling such as the combustion face and the fuel injector seat 302. As shown in FIG. 5, drilling of the valve bridge passages 340 allows a distance between the valve bridge passages 340 and the combustion face 304 to be minimized compared to casting of similar structures in a conventional cylinder head. Similarly, drilling of the valve bridge passages 340 allows the distance between the valve bridge passages 340 and the fuel injector seat 302 to be minimized compared to casting of similar structures in a conventional cylinder head. In some embodiments, the valve bridge passages 340 extend past the water jacket connectors 350 towards the fuel injector seat 302. As shown in FIG. 7, the cylinder head cooling arrangement 100 further includes valve seats 700. Further, the drilling of the valve bridge passages 340 also allows the distance between the valve bridge passages 340 and the valve seats 700 to be minimized compared to casting of similar structures in a conventional cylinder head.

Being drilled, the water jacket connectors 350 have many advantages compared to similar structures in a conventional cylinder head. In particular, cored passages are fragile and prone to leakage. By being formed through drilling, the water jacket connectors 350 may be robust and sealed. Further, as previously noted, casting structures may leave behind sand or other debris that is difficult to remove from the formed structure. Due to the drilled nature of both of the valve bridge passages 340 and the water jacket connectors 350, they may be easily formed in different shapes, sizes and configurations by using a different drilling bit or procedure. This allows the cylinder head cooling arrangement 100 to be easily tailored for a target application (e.g., to achieve a desired flow balance, etc.). Because the valve bridge passages 340 and the water jacket connectors 350 are drilled, consistent and predictable flow rates may be predicted whereas with casted structures flow rates may vary based on cooling time, casting material, pour temperature, and other similar variables. In some embodiments, a diameter of the valve bridge passages 340 and/or the water jacket connectors 350 is on the order of a few millimeters. Such a small diameter is not possible to achieve through conventional casting processes. Accordingly, by being drilled the valve bridge passages 340 and the water jacket connectors 350 provide additional flexibility over conventional, cast structures.

The design of cylinder heads can be tested in a variety of ways to ensure that desirable characteristics are attained. One manner of testing the design of cylinder heads is through a hot high cycle fatigue load case in a finite element analysis (FEA). This testing allows for bending, stresses, fatigue, and other variables to be observed on the cylinder heads.

Figure 10:
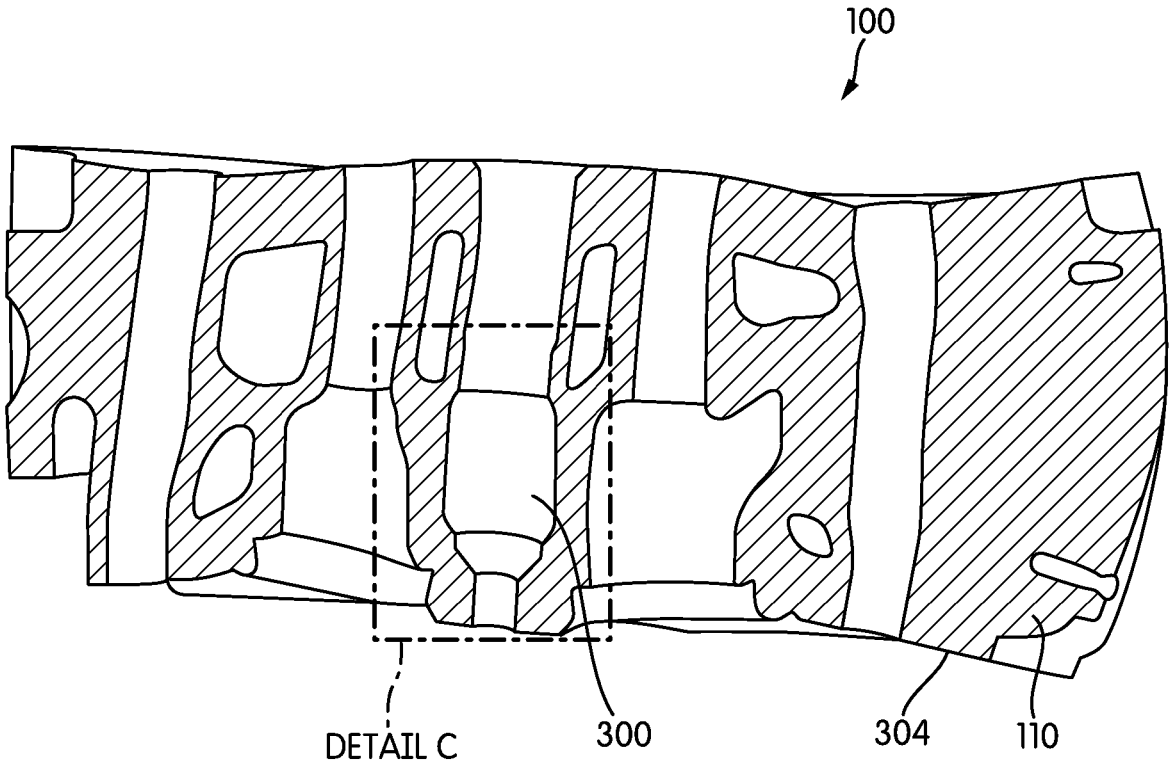
FIG. 10 is a contour plot of fatigue stress from an analysis of the cross-sectional view of the cylinder head cooling arrangement shown in FIGS. 1 and 2, according to an exemplary embodiment.
Figure 11:
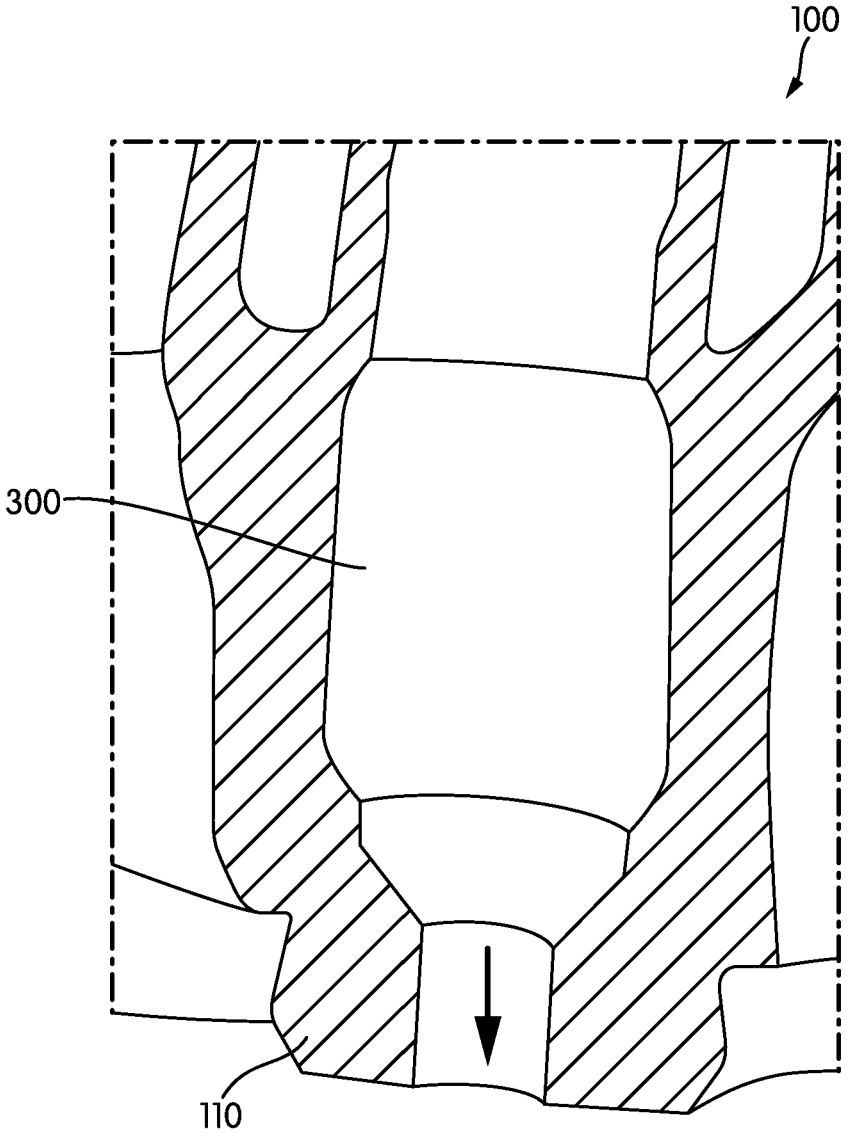
FIG. 11 is a detailed view of DETAIL C of the contour plot of fatigue stress from the analysis shown in FIG. 10.
Figure 12:
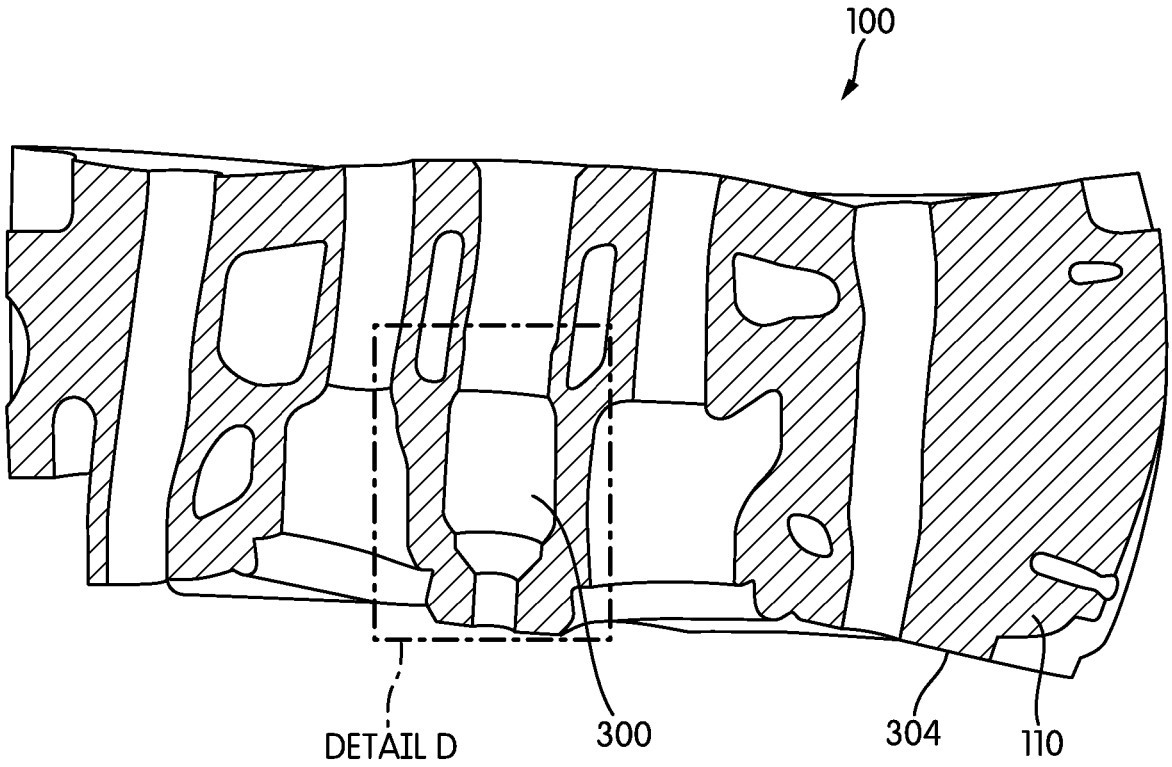
FIG. 12 is a contour plot of fatigue stress from another analysis of the cross-sectional view of the cylinder head cooling arrangement shown in FIGS. 1 and 2, according to an exemplary embodiment.
Figure 13:
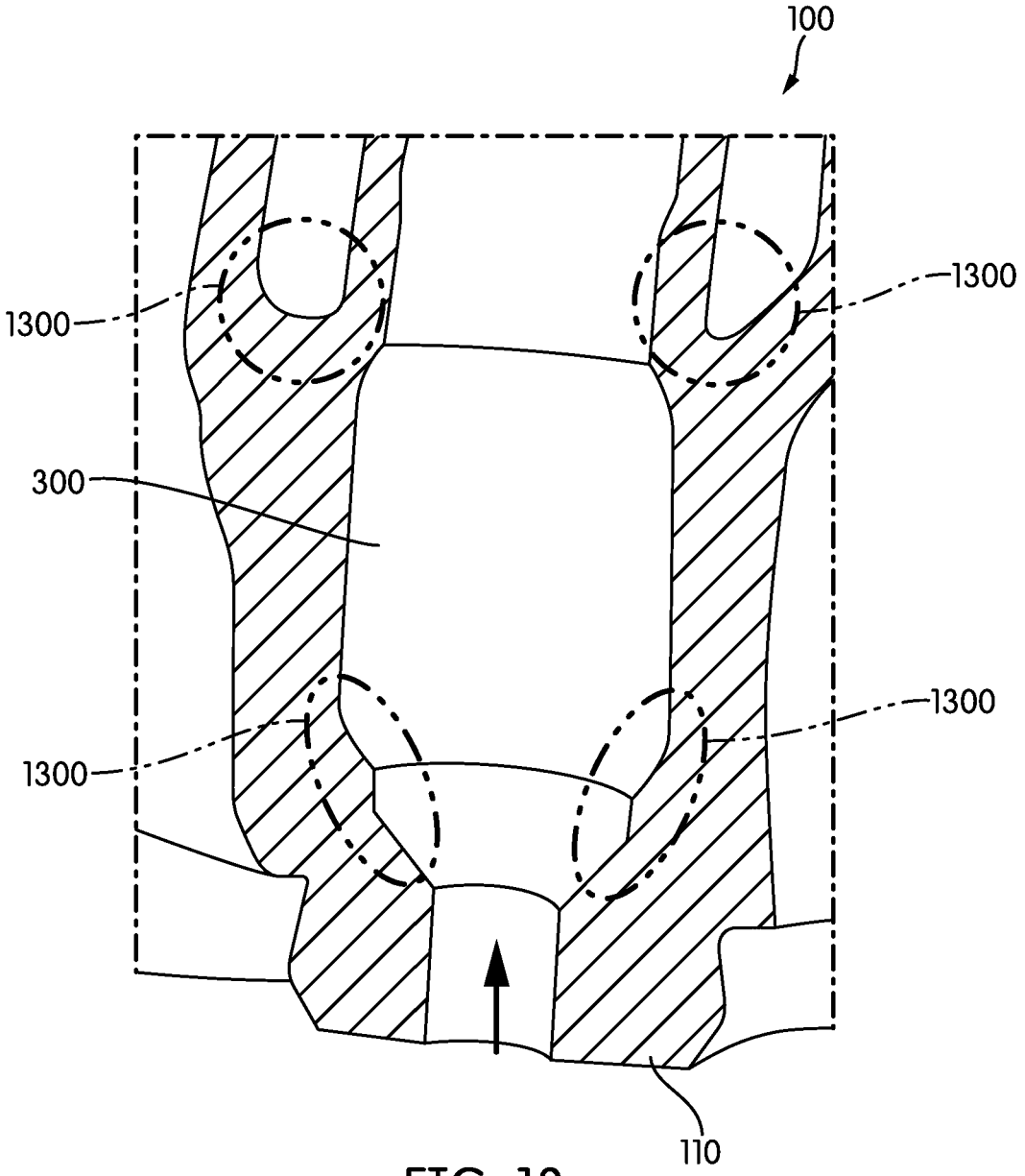
FIG. 13 is a detailed view of DETAIL D of the contour plot of fatigue stress from the analysis shown in FIG. 12.

FIGS. 10-13 are contour plots illustrating fatigue stress from an FEA analysis of the cylinder head cooling arrangement 100, shown in gray scale. FIGS. 10 and 11 illustrate a first load case and FIGS. 12 and 13 illustrate a second load case. In the first load case, the combustion face 304 expands due to thermal growth and the center of the combustion face 304 is biased downwards. In the second load case, pressure from the cylinder is applied and the center of the combustion face 304 is biased upwards.

Because the valve bridge passages 340 and the water jacket connectors 350 are drilled, the areas of the cylinder head 110 surrounding the fuel injector 300 may be thicker than similar portions in a conventional cylinder head having cast structures. In some cases, drilling of the valve bridge passages 340 and the water jacket connectors 350 allows the areas of the cylinder head 110 surrounding the fuel injector 300 to be two to three times thicker than similar portions in the conventional cylinder head. This discourages bending from occurring in locations such as regions 1300 proximate the fuel injector 300, where bending is likely to occur in the conventional cylinder head. As a result, in some embodiments, portions of the cylinder head 110 proximate the fuel injector 300 are not subjected to meaningful bending, thus increasing the desirability of the cylinder head cooling arrangement 100.

By implementing the cylinder head cooling arrangement 100 in an internal combustion engine, durability, and therefore desirability, of the cylinder head 110 may be increased. Through the use of the valve bridge passages 340 and the water jacket connectors, areas of the cylinder proximate the fuel injector 300 may be thicker than in conventional internal combustion engines. This thickness provides increased strength and rigidity to the cylinder head 110.

FIGS. 14-18 are block diagrams illustrating various configurations of the cylinder head cooling arrangement 100, according to several embodiments. The cylinder head cooling arrangement 100 includes the cylinder head 110 and a cylinder block 1400. The cylinder head 110 includes a plurality of first water jackets 1410 and a plurality of second water jackets 1420 and the cylinder block 1400 includes a plurality of third water jackets 1430. It is understood that any of the plurality of first water jackets 1410 and the plurality of second water jackets 1420 may be the upper water jackets 320 and the lower water jackets 330, respectively, as previously described. Accordingly, the following description of the plurality of first water jackets 1410 and the plurality of second water jackets 1420 similarly applies to the upper water jackets 320 and lower water jackets 330 where suitable.

Figure 14:
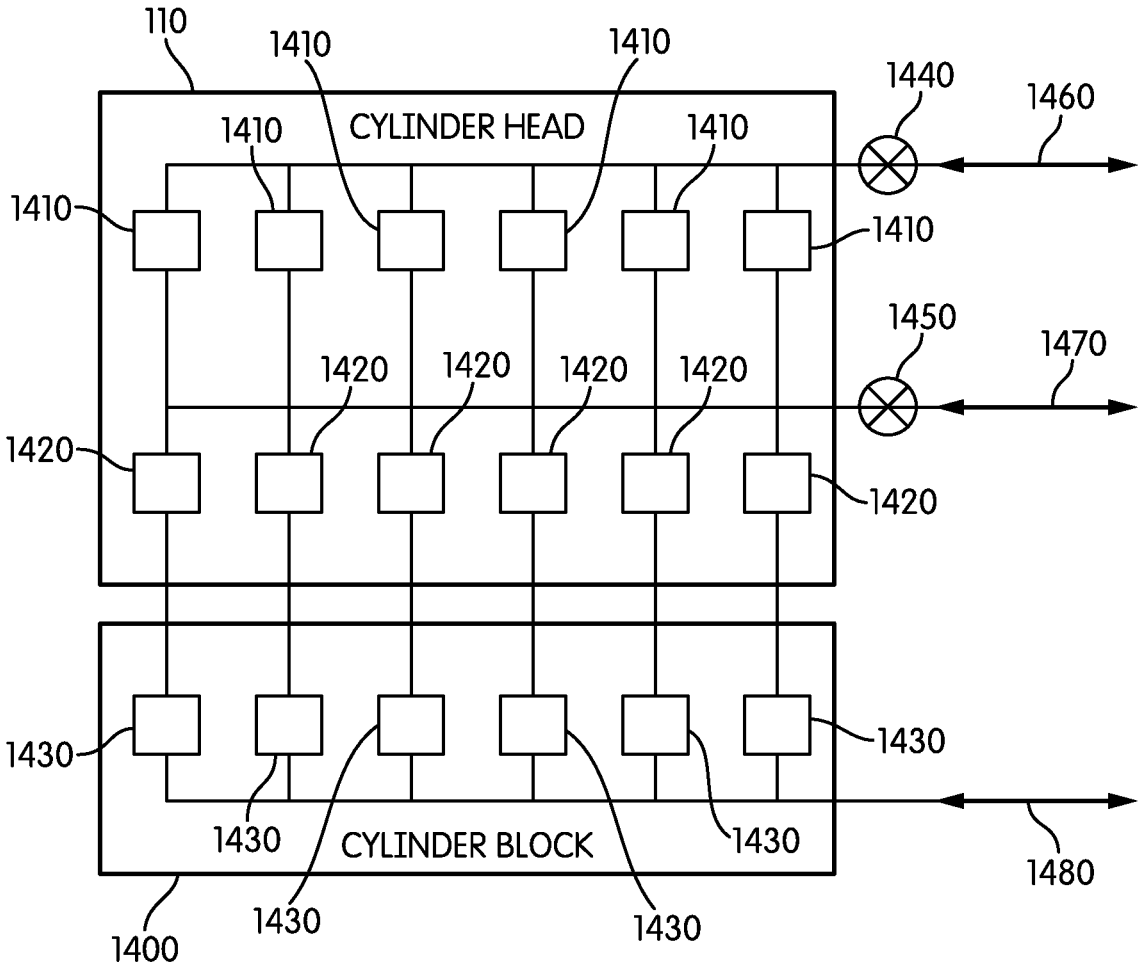
FIG. 14 is a block diagram of a cylinder head cooling arrangement, according to an exemplary embodiment.

Referring now to FIG. 14, the cylinder head cooling arrangement 100 further includes a first valve 1440 and a second valve 1450, according to an embodiment. According to an exemplary embodiment, the plurality of first water jackets 1410 is separate from the plurality of second water jackets 1420 while sharing a common coolant with the plurality of second water jackets. The plurality of first water jackets 1410 may be coupled to the plurality of second water jackets 1420 and the plurality of second water jackets 1420 may be coupled to the plurality of third water jackets. The plurality of first water jackets 1410 are structured to have a first fluid connection 1460, the plurality of second water jackets 1420 are structured to have a second fluid connection 1470, and the plurality of third water jackets 1430 are structured to have a third fluid connection 1480. Depending on the configuration of the cylinder head cooling arrangement 100, any of the first fluid connection 1460, the second fluid connection 1470, and the third fluid connection 1480 may receive or supply coolant to the cylinder head cooling arrangement 100. In an exemplary embodiment, all of the first fluid connection 1460, the second fluid connection 1470, and the third fluid connection 1480 share a common pump.

According to various embodiments, the first valve 1440 facilitates individual control of the flow of coolant through the first fluid connection 1460 and the second valve 1450 facilitates individual control of the flow of coolant through the second fluid connection 1470. Through the use of the first valve 1440 and the second valve 1450, the cylinder head cooling arrangement 100 may tailor a flow rate of coolant to a required rate of coolant of any of the plurality of first water jackets 1410, the plurality of second water jackets 1420, and the plurality of third water jackets 1430. In this way, excess flow of coolant may be avoided and parasitic power drawn to handle the excess flow may be reduced.

In some embodiments, the plurality of second water jackets 1420 is a combination of the upper water jackets 320 and the lower water jackets 330. Depending on the application, any of the plurality of first water jackets 1410, the plurality of second water jackets 1420, and the plurality of third water jackets 1430 may be combined to form a common water jacket. For example, the plurality of second water jackets 1420 may be combined with the plurality of third water jackets 1430 to form a common plurality of water jackets. In another example, the plurality of first water jackets 1410 and the plurality of second water jackets 1420 may be combined to form a common plurality of water jackets. In this way, the cylinder head cooling arrangement 100 may utilize two separate cooling jackets, one being the common plurality of water jackets, each having a different level of cooling applied by varying the flow rate through the use of at least one of the first valve 1440 and the second valve 1450.

The cylinder head cooling arrangement 100 illustrated in FIG. 14 includes only one cooling circuit. In particular, the cylinder head cooling arrangement 100 includes a first cooling circuit comprising the plurality of first water jackets 1410, the plurality of second water jackets 1420, the plurality of third water jackets 1430, the first valve 1440, and the second valve 1450. In some embodiments, the cylinder head cooling arrangement 100 also includes a waste heat recovery system fluidly and operatively coupled to the first cooling circuit. The first cooling circuit also includes a first pump structured to circulate a coolant through the first cooling circuit. The first pump is structured to circulate the coolant at a first flowrate so as to provide single-stage cooling for the cylinder head cooling arrangement 100.

Figure 15:
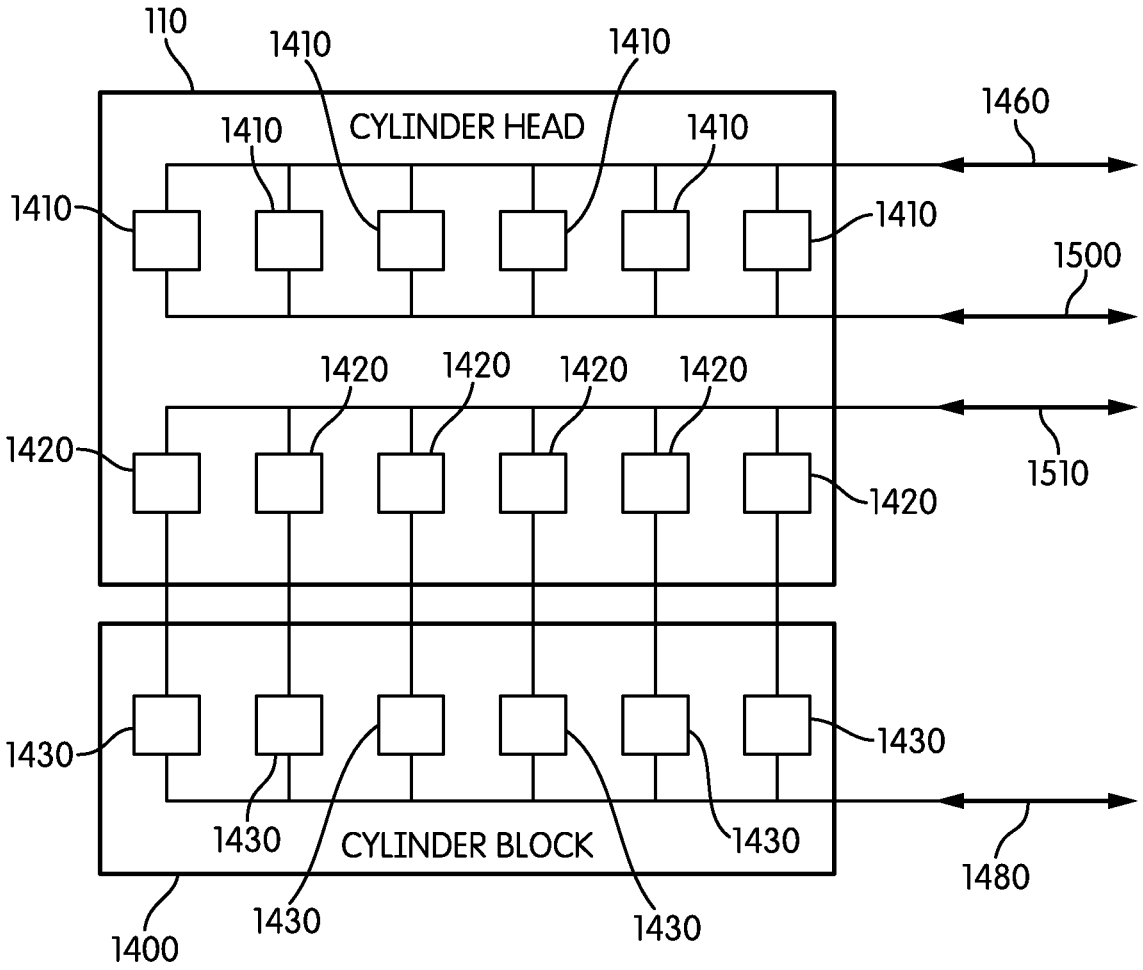
FIG. 15 is a block diagram of another cylinder head cooling arrangement, according to an exemplary embodiment.

FIG. 15 illustrates an embodiment where the plurality of first water jackets 1410 are not directly coupled to either the plurality of second water jackets 1420 or the plurality of third water jackets 1430 and where the plurality of second water jackets 1420 are coupled to the plurality of third water jackets 1430. As shown in FIG. 15, the cylinder head cooling arrangement 100 further includes a fourth fluid connection 1500, coupled to the plurality of first water jackets 1410, and a fifth fluid connection 1510, coupled to the plurality of second water jackets 1420. In some embodiments, one of the first fluid connection 1460 and the fourth fluid connection 1500 is a supply line and the other one of the first and fourth fluid connections 1460, 1500 is a return line. Similarly, in some embodiments, one of the third fluid connection 1480 and the fifth fluid connection 1510 is a supply line and the other one of the third and fifth fluid connections 1480, 1510 is a return line.

In some embodiments, the plurality of first water jackets 1410 is coupled to a first pump, and the plurality of second water jackets 1420 and the plurality of third water jackets 1430 are coupled to a second pump. Following these embodiments, the flow through the plurality of first water jackets 1410 and the flow through the plurality of second water jackets 1420 and the plurality of third water jackets 1430 may each be tailored according to a required flow rate of at least one of the plurality of first water jackets 1410, the plurality of second water jackets 1420, and the plurality of third water jackets 1430. In this way, excess flow of coolant may be avoided and parasitic power drawn to handle the excess flow may be reduced.

In another embodiment, the plurality of first water jackets 1410, the plurality of second water jackets 1420 and the plurality of third water jackets 1430 are coupled to a common pump. Following this embodiment, the common pump may utilize a different temperature for the coolant circulated in the plurality of first water jackets 1410, and the plurality of second water jackets 1420 which are coupled to the plurality of third water jackets 1430. This temperature differential may be attained by providing supplemental cooling at one of the first fluid connection 1460, the fourth fluid connection 1500, the fifth fluid connection 1510, and the third fluid connection 1480.

The cylinder head cooling arrangement 100 illustrated in FIG. 15 includes two cooling circuits. In particular, the cylinder head cooling arrangement 100 includes a first cooling circuit comprising the plurality of first water jackets 1410, and a second cooling circuit comprising the plurality of second water jackets 1420 and the plurality of third water jackets 1430. The plurality of first water jackets 1410 are not fluidly coupled to the plurality of second and third water jackets 1420, 1430. In some embodiments, the cylinder head cooling arrangement 100 also includes a waste heat recovery system fluidly and operatively coupled to at least one of the first and second cooling circuits. As noted, the first cooling circuit also includes a first pump structured to circulate a coolant through the first cooling circuit, and the second cooling circuit includes a second pump structured to circulate a coolant through the second cooling circuit. The first and second pumps are structured to circulate the coolant at independent flow rates (e.g., first and second flowrates) so as to provide two-stage cooling for the cylinder head cooling arrangement 100.

Figure 16:
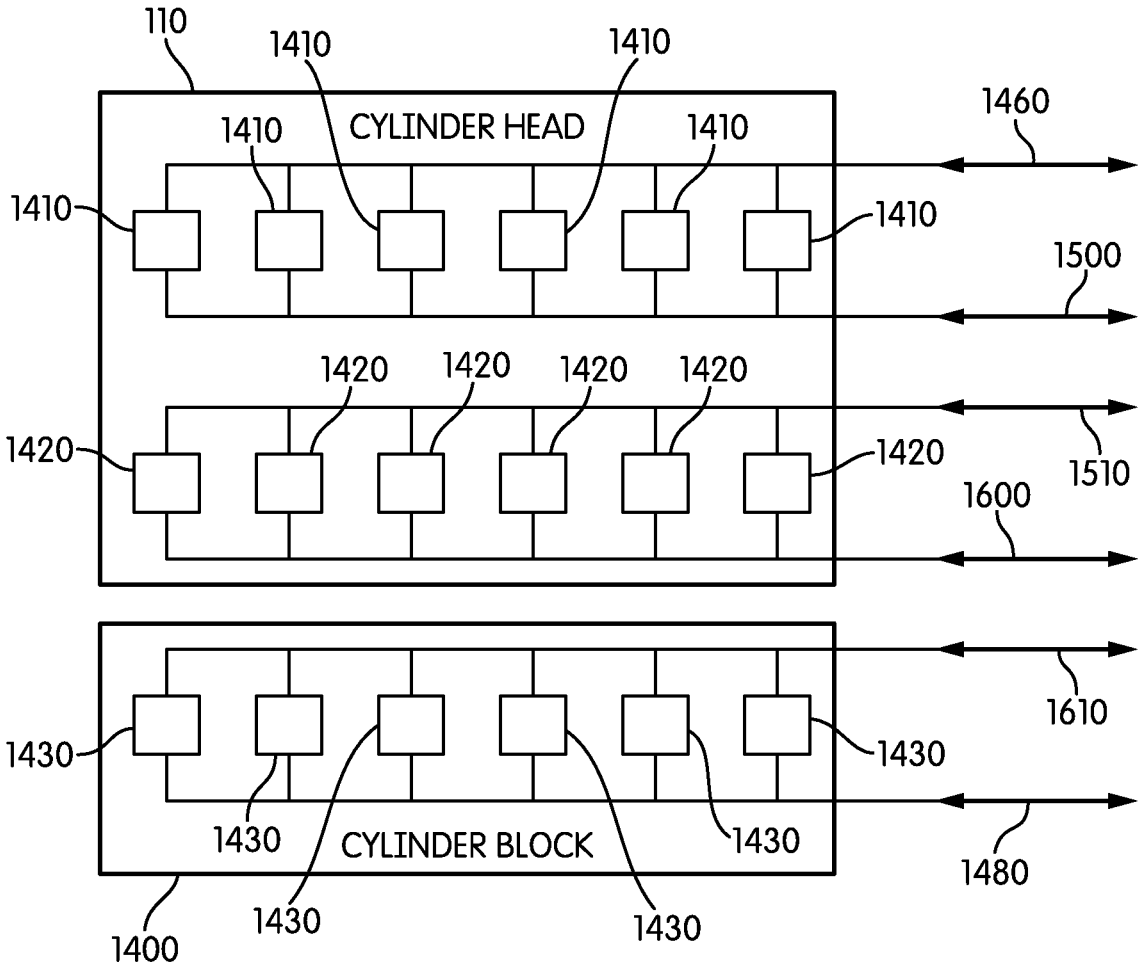
FIG. 16 is a block diagram of yet another cylinder head cooling arrangement, according to an exemplary embodiment.

FIG. 16 illustrates an embodiment where the plurality of first water jackets 1410 are not directly coupled to either the plurality of second water jackets 1420 or the plurality of third water jackets 1430 and where the plurality of second water jackets 1420 are not coupled to the plurality of third water jackets 1430. In this way, the plurality of first water jackets 1410, the plurality of second water jackets 1420, and the plurality of third water jackets 1430 may be managed (e.g., operated, controlled, etc.) separately (e.g., independently). This separate control may facilitate smart control of the cylinder head cooling arrangement 100. Further, this may allow thermal response different areas of an internal combustion engine (e.g., the cylinder head 110, the cylinder block 1400, etc.) to be managed separately. This control by the cylinder head cooling arrangement 100 also allows for different temperatures to be maintained within different areas of the cylinder head 110 and the cylinder block 1400. For example, a first temperature may be maintained within the upper water jackets 320 and a second temperature may be maintained within the lower water jackets 330.

As shown in FIG. 16, the cylinder head cooling arrangement 100 further includes a sixth fluid connection 1600, coupled to the plurality of first water jackets 1410, and a seventh fluid connection 1610, coupled to the plurality of second water jackets 1420. According to various embodiments, each of the plurality of first water jackets 1410, the plurality of second water jackets 1420, and the plurality of third water jackets 1430 may each be coupled to a different pump and may each circulate a different fluid at a different flow rate and/or temperature. In this way, the temperature of each of the cylinder head 110 and the cylinder block 1400 may be controlled independently.

Following these embodiments, the flow through the plurality of first water jackets 1410, the flow through the plurality of second water jackets 1420, and the flow through the plurality of third water jackets 1430 may each be tailored according to a required flow rate of the plurality of first water jackets 1410, the plurality of second water jackets 1420, and the plurality of third water jackets 1430, respectively. In this way, excess flow of coolant may be avoided and parasitic power drawn to handle the excess flow may be reduced.

The cylinder head cooling arrangement 100 illustrated in FIG. 16 includes three cooling circuits. In particular, the cylinder head cooling arrangement 100 includes a first cooling circuit comprising the plurality of first water jackets 1410, a second cooling circuit comprising the plurality of second water jackets 1420, and a third cooling circuit comprising the plurality of third water jackets 1430. The plurality of first, second, and third water jackets 1410, 1420, 1430 are not fluidly coupled to each other. In some embodiments, the cylinder head cooling arrangement 100 also includes a waste heat recovery system fluidly and operatively coupled to at least one of the first and second cooling circuits. As noted, the first cooling circuit also includes a first pump structured to circulate a coolant through the first cooling circuit, the second cooling circuit includes a second pump structured to circulate a coolant through the second cooling circuit, and the third cooling circuit includes a third pump structured to circulate a coolant through the third cooling circuit. The first, second, and third pumps are structured to circulate the coolant at independent flow rates (e.g., first, second, and third flowrates) so as to provide three-stage cooling for the cylinder head cooling arrangement 100. In some embodiments, a first coolant is utilized in one of the first, second, and third cooling circuits, and a second coolant is utilized in another one of the first, second, and third cooling circuits.

Figure 17:
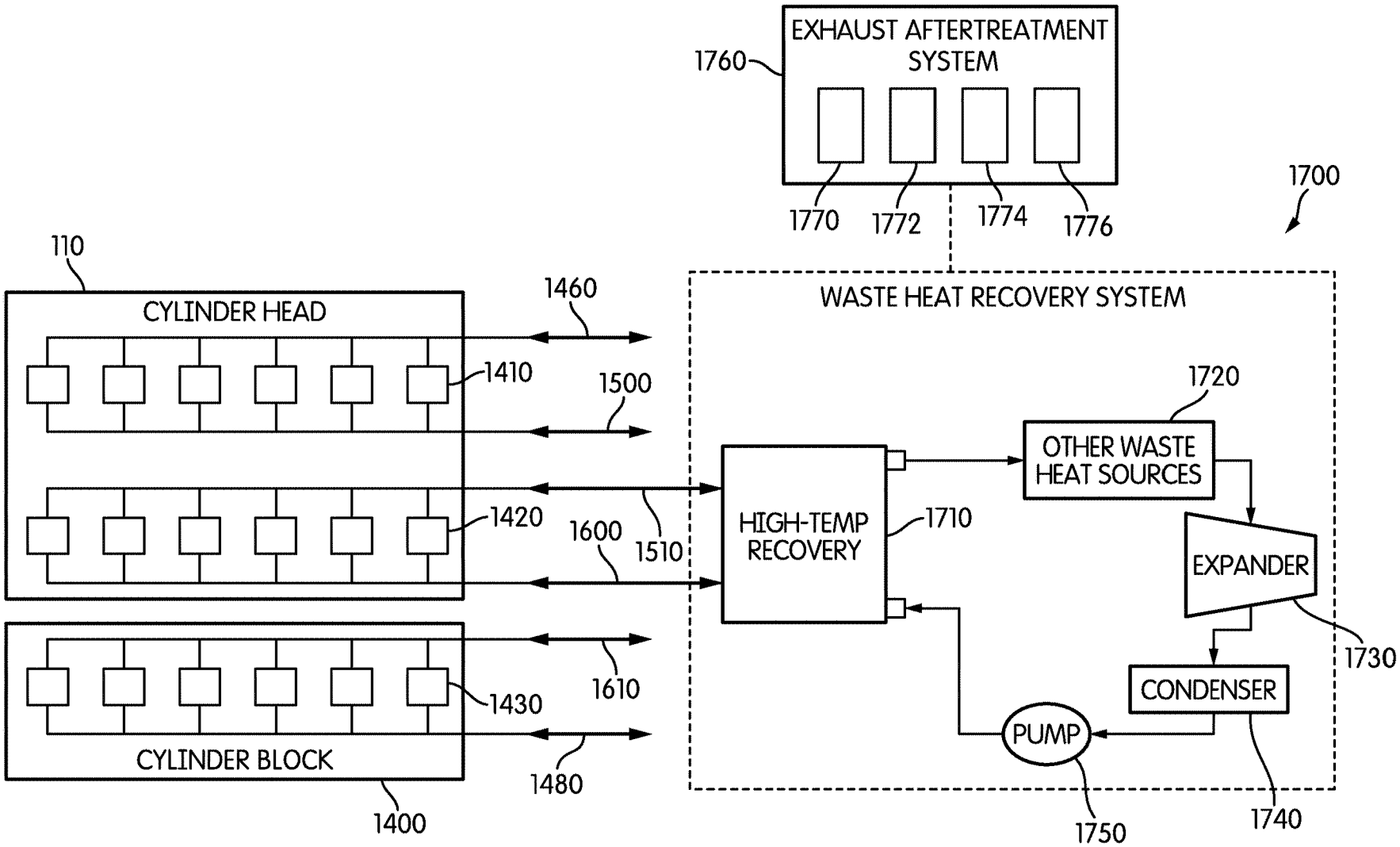
FIG. 17 is a block diagram of a cylinder head cooling arrangement including a waste heat recovery system, according to an exemplary embodiment.
Figure 18:
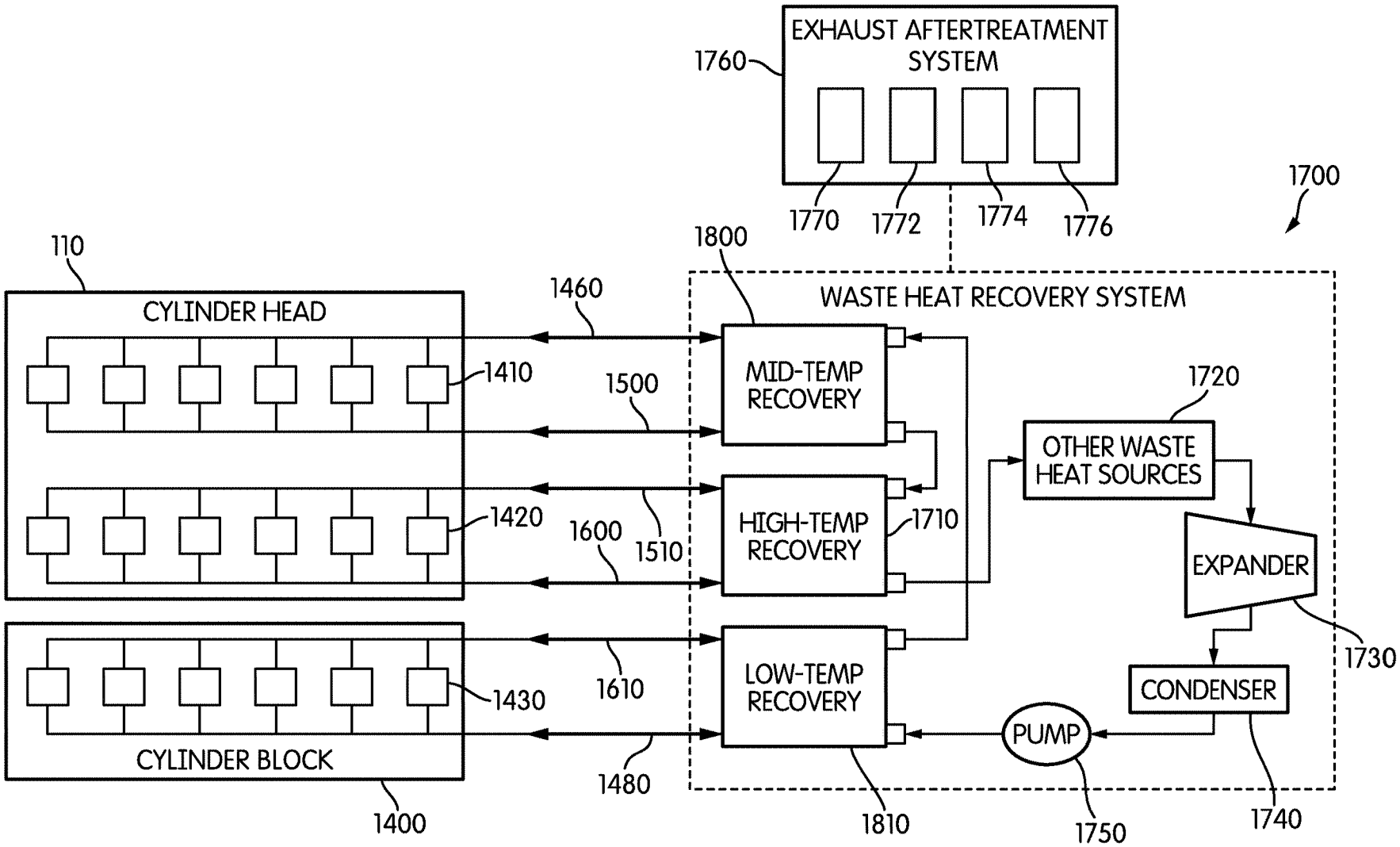
FIG. 18 is a block diagram of another cylinder head cooling arrangement including a waste heat recovery system, according to an exemplary embodiment.

FIGS. 17 and 18 are block diagrams of the cylinder head cooling arrangement 100 further including a waste heat recovery system 1700, according to various embodiments. According to various embodiments, the waste heat recovery system 1700 includes a high-temperature recovery 1710, other waste heat sources 1720, an expander 1730, a condenser 1740, and a pump 1750. In some embodiments, the waste heat recovery system 1700 does not include the other waste heat sources 1720 and/or the high-temperature recovery 1710.

According to various embodiments, the high-temperature recovery 1710 is coupled to the fifth fluid connection 1510 and the sixth fluid connection 1600. However, in other embodiments, the high-temperature recovery 1710 is coupled to any or all of the first fluid connection 1460, the third fluid connection 1480, the fourth fluid connection 1500, the fifth fluid connection 1510, the sixth fluid connection 1600, and the seventh fluid connection 1610. In an exemplary embodiment, the high-temperature recovery 1710 is structured to be coupled to the plurality of second water jackets 1420. However, in other embodiments, the high-temperature recovery 1710 is coupled to any of the plurality of first water jackets 1410, the plurality of second water jackets 1420, and the plurality of third water jackets 1430. The high-temperature recovery 1710 may comprise one or more heat exchange devices. For example, in one embodiment, the high-temperature recovery 1710 is an evaporator or boiler.

As shown in FIG. 18, the waste heat recovery system 1700 may further include a mid-temperature recovery 1800 and a low-temperature recovery 1810. According to an exemplary embodiment, the mid-temperature recovery 1800 is coupled to the plurality of first water jackets 1410 and to the high-temperature recovery 1710 and the low-temperature recovery 1810 is coupled to the plurality of third water jackets 1430 and the mid-temperature recovery 1800. Following the embodiment shown in FIG. 18, a common coolant is circulated from the low-temperature recovery 1810 to the mid-temperature recovery 1800 and then to the high-temperature recovery 1710 which then circulates the coolant to the other waste heat sources 1720, the expander 1730, the condenser 1740, the pump 1750, and back to the low-temperature recovery 1810.

Through the use of the waste heat recovery system 1700 illustrated in FIGS. 17 and 18, waste heat from cooling of an internal combustion engine can be harvested as various temperature levels. In some applications, the high-temperature recovery 1710, the mid-temperature recovery 1800, and the low-temperature recovery 1810 may be located at locations of the internal combustion engine based on an expected temperature of that location of the internal combustion engine. For example, the high-temperature recovery 1710 may be located near an exhaust manifold of the internal combustion engine and the low-temperature recovery 1810 may be located near a fan outlet of the internal combustion engine. In this way, the waste heat from the various locations of the internal combustion engine may be harvested optimally and in an efficient manner. According to various embodiments, any of the high-temperature recovery 1710, the mid-temperature recovery 1800, and the low-temperature recovery 1810 may comprise one or more heat exchange devices. For example, in one embodiment, at least one of the high-temperature recovery 1710, the mid-temperature recovery 1800, and the low-temperature recovery 1810 is an evaporator, boiler, pre-heater, etc.

The waste heat recovery system 1700 may further include a working fluid circulation system. The working fluid circulation system may be used to circulate a working fluid through the cylinder head 110 and/or the cylinder block 1400. In this way, the waste heat recovery system 1700 may provide cooling to the plurality of first water jackets 1410, the plurality of second water jackets 1320, and the plurality of third water jackets 1430.

In one embodiment, the cylinder head cooling arrangement 100 may be implemented such that the waste heat recovery system 1700 is utilized for thermal management of an exhaust aftertreatment system 1760. For example, the waste heat recovery system 1700 may include various exhaust aftertreatment components of the exhaust aftertreatment system 1760, such as a particulate filter 1770, a DEF dosing valve 1772, a decomposition reactor 1774, and a selective catalytic reduction (SCR) catalyst 1776. According to an embodiment, the waste heat recovery system 1700 controls the DEF dosing valve 1772 for thermal management of exhaust aftertreatment. In this way, consumption of DEF may be optimized (e.g., reduced) to meet the needs of the waste heat recovery system 1700. Similarly, consumption of combustion fuel (e.g., diesel, gasoline, natural gas, propane, etc.) may be optimized by the cylinder head cooling arrangement 100 to meet the needs of the internal combustion engine.

Further, emissions may also be optimized (e.g., reduced) through the use of the cylinder head cooling arrangement 100. For example, the emission of nitric oxide and nitrogen dioxide (e.g., $NO_R$, etc.) may be minimized based on the internal combustion engine. Similarly, consumption of oil may be minimized to match the current needs of the internal combustion engine. In some embodiments, combustion occurring in the internal combustion engine is optimized by the cylinder head cooling arrangement 100 such that combustion blow-by is reduced.

In another embodiment, the cylinder head cooling arrangement 100 may be implemented such that a warm-up time of the internal combustion engine is reduced. Further, the cylinder head cooling arrangement 100 may be implemented such that temperatures of the cylinder block 1400 may be attained that are greater than temperatures of cylinder blocks in conventional internal combustion engines, thereby reducing parasitic friction in the internal combustion engine.

Depending on the application, the cylinder head cooling arrangement 100 may be utilized in a variety of internal combustion engines. For example, the implemented in either a spark ignition internal combustion engine (e.g., gasoline engine, etc.) or a compression ignition internal combustion engine (e.g., diesel engine, etc.).

In another embodiment, the cylinder head cooling arrangement 100 may be implemented such that pumping requirements (e.g., pumping power) of a pump in the cooling system 310 is reduced. For example, by optimizing the thermal management of the internal combustion engine, variations in pumping requirements may be smoothed out over time, thereby eliminating pumping requirement spikes and prolonging the life of the pump.

By allowing the plurality of first water jackets 1410, the plurality of second water jackets 1420, and the plurality of third water jackets 1430 to be isolated from the others (e.g., not directly coupled to), an optimal sequence of heat extraction may be performed. For example, energy from the lowest temperature heat source may be harvested first, followed by increasingly higher temperature heat sources. In this way, operation of the cylinder head cooling arrangement 100 mimics counter-flow heat extraction from the internal combustion engine to the waste heat recovery system 1700. Further, by allowing the plurality of first water jackets 1410, the plurality of second water jackets 1420, and the plurality of third water jackets 1430 to be isolated from the others (e.g., not directly coupled to), heat extraction from a single heat source may be facilitated in an efficient and cost-effective manner.

Figure 19:
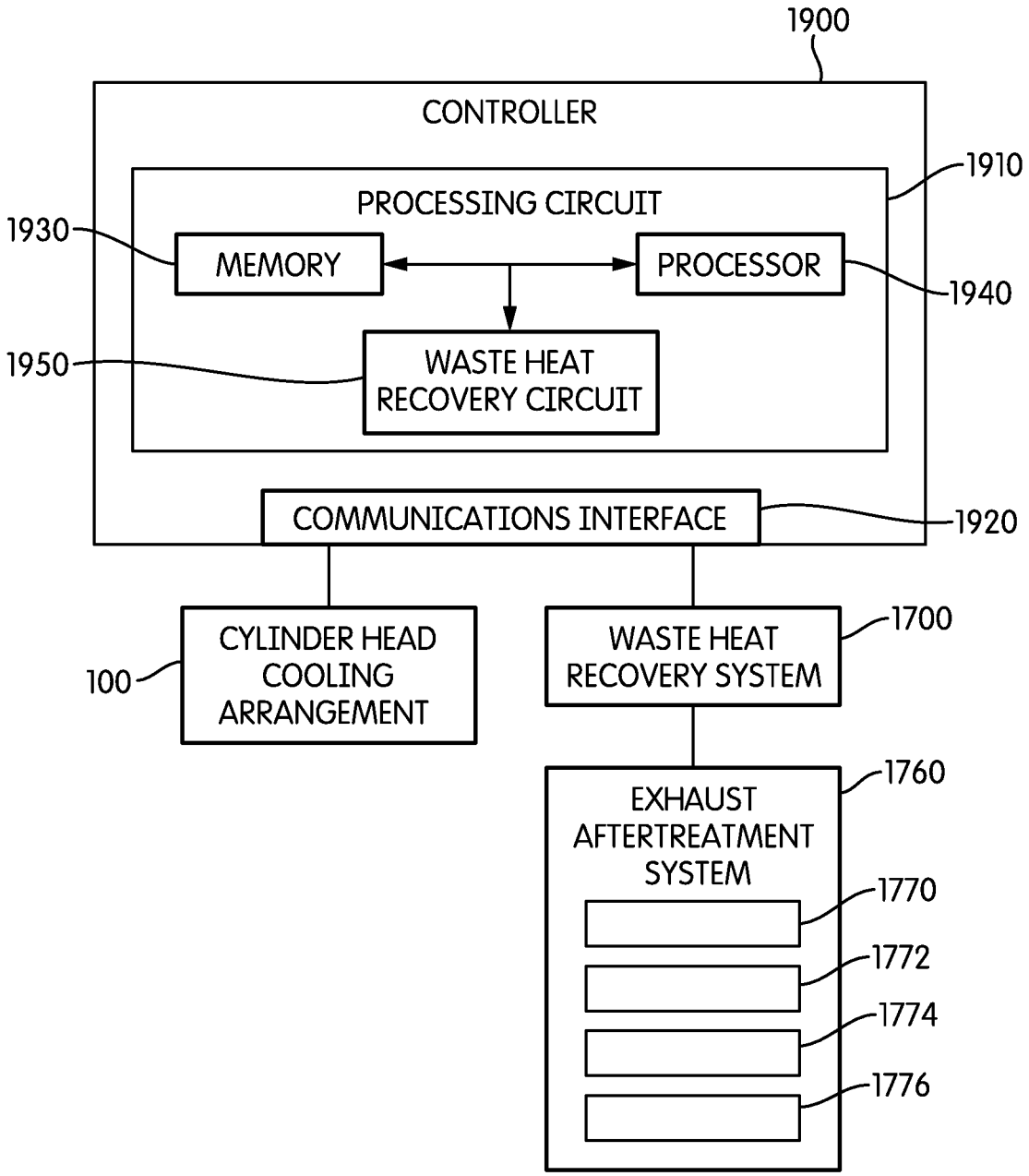
FIG. 19 is a schematic diagram of a controller for a cylinder head cooling arrangement, according to an exemplary embodiment.

As shown in FIG. 19, the cylinder head cooling arrangement 100 is controlled by a controller 1900 according to a control scheme, according to one embodiment. The controller 1900 may include a processing circuit 1910 and a communications interface 1920. The processing circuit 1910 may include a memory 1930, a processor 1940, and a waste heat recovery circuit 1950. The memory 1930 may be communicably connected to the processor 1940. The memory 1930 (e.g., RAM, ROM, Flash Memory, hard disk storage, etc.) may store data and/or computer code for facilitating the various processes described herein. The memory 1930 may be communicably connected to the processor 1940 and the waste heat recovery circuit 1950 and structured to provide computer code or instructions to the processor 1940 for executing the processes described in regard to the cylinder head cooling arrangement 100 and the waste heat recovery system 1700 herein. Moreover, the memory 1930 may be or include tangible, non-transient volatile memory or non-volatile memory. Accordingly, the memory 1930 may include database components, object code components, script components, or any other type of information structure for supporting the various activities and information structures described herein. The processor 1940 may be implemented as a general-purpose processor, an application specific integrated circuit (ASIC), one or more field programmable gate arrays (FPGAs), a digital signal processor (DSP), a group of processing components, or other suitable electronic processing components.

The communications interface 1920 may facilitate communication between the controller 1900 and the cylinder head cooling arrangement 100 and/or the waste heat recovery system 1700. The control scheme may be implemented by the processing circuit 1910. The memory 1930 may store instructions executable by the processor 1940. The processing circuit 1910 may communicate with external systems and devices (e.g., computers, mobile phones, etc.) to receive computer-code instructions and/or transmit information. In some embodiments, the control scheme is a closed-loop control scheme based on a critical temperature (e.g., a temperature threshold, etc.) within the cylinder head 110 or the cylinder block 1400. In other embodiments, the controller 1900 is operated based on information from the waste heat recovery system 1700. In these embodiments, the waste heat recovery circuit 1950 may interpret the information from the waste heat recovery system 1700. In other embodiments, the controller 1900 utilizes the waste heat recovery circuit 1950 to control the waste heat recovery system 1700.

For example, the cylinder head cooling arrangement 100 may be controlled by the controller 1900 in order to maintain the temperature of the cylinder head 110 below three-hundred and seventy-five degrees Kelvin. In other embodiments, the control scheme is an open-loop control scheme that maps valve position against operating point. In these embodiments, information from the mapping may be stored in the memory 1930. In some embodiments, the controller 1900 interfaces with the first valve 1440 and the second valve 1450.

While various circuits with particular functionality are shown in FIG. 19, it should be understood that the controller 1900, the waste heat recovery circuit 1950, and/or the memory 1930 may include any number of circuits for completing the functions described herein. For example, the activities and functionalities of high-temperature recovery 1710, the mid-temperature recovery 1800, the low-temperature recovery, the expander 1730, the condenser 1740, and the pump 1750 may be embodied in the memory 1930, or combined in multiple circuits or as a single circuit. Additional circuits with additional functionality may also be included. Further, it should be understood that the controller 1900 may further control other activity beyond the scope of the present disclosure.

Depending on the application, operation of the cylinder head cooling arrangement 100 may be dynamically changed based on an input. For example, operation of the cylinder head cooling arrangement 100 may change based on the temperature of the cylinder head 110. Similarly, operation of the cylinder head cooling arrangement 100 may change as the internal combustion engine ages, as oil in the internal combustion engine ages, or as supplemental fluids such as DEF are depleted. To cause these changes, an amount of heat rejected by the cylinder head cooling arrangement 100 may be changed. For example, the amount of heat rejected by the cylinder head cooling arrangement 100 may be less when the internal combustion engine has just started and is in a warm-up phase and more when the internal combustion engine has reached a desired operating temperature.

Certain operations of the controller 1900 described herein may include operations to interpret and/or to determine one or more parameters. Interpreting or determining, as utilized herein, includes receiving values by any method known in the art, including at least receiving values from a datalink or network communication, receiving an electronic signal (e.g., a voltage, frequency, current, or PWM signal) indicative of the value, receiving a computer generated parameter indicative of the value, reading the value from a memory location on a non-transient computer readable storage medium, receiving the value as a run-time parameter by any means known in the art, and/or by receiving a value by which the interpreted parameter can be calculated, and/or by referencing a default value that is interpreted to be the parameter value.

Figure 20:
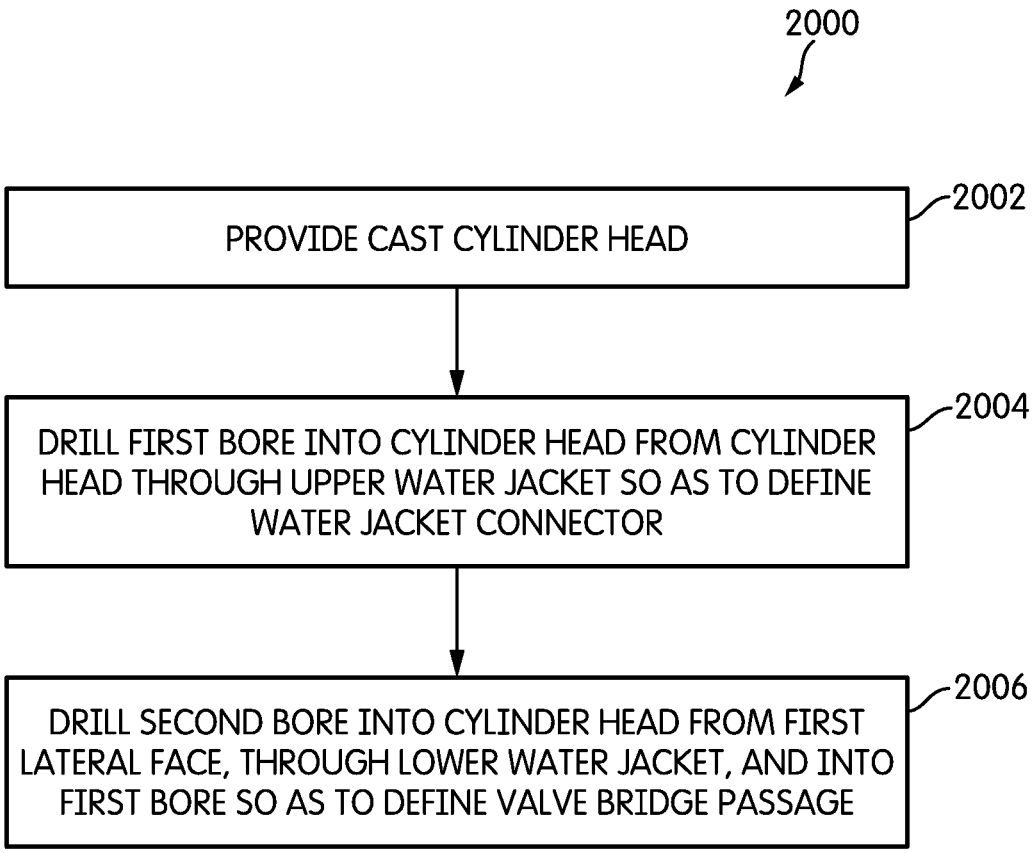
FIG. 20 is a flow diagram illustrating a method of manufacturing a cylinder head, according to an exemplary embodiment.

FIG. 20 is a flow diagram illustrating a method 2000 of manufacturing a cylinder head, according to an embodiment. For example, the method 2000 may be used to manufacture the cylinder head cooling arrangement 100.

At 2002, a cast cylinder head is provided. The cast cylinder head includes a combustion face and a top face opposite the combustion face. The cast cylinder head also includes a first lateral face and a second lateral face opposite the first lateral face. The cast cylinder head further includes an upper water jacket, a lower water jacket, and an injector bore extending from the top face to the combustion face along a first central axis. In an embodiment, each of the upper water jacket, the lower water jacket, and the injector bore is formed when casting the cylinder head.

At 2004, a first bore is drilled into the cylinder head from the cylinder head face through the upper water jacket so as to define a water jacket connector. The first bore extends along a second central axis that is parallel to the first central axis.

At 2006, a second bore is drilled into the cylinder head from the first lateral face, through the lower water jacket, and into the first bore so as to define a valve bridge passage. The second bore extends along a third central axis. The third central axis is perpendicular to the first central axis. The second bore extends through the first bore towards an injector seat defined by the injector bore. The upper and lower water jackets are fluidly coupled via the water jacket connector and the valve bridge passage. The water jacket connector is in fluid communication with each of the upper water jacket and the valve bridge passage. The valve bridge passage is in fluid communication with the lower water jacket.

While the present disclosure contains specific implementation details, these should not be construed as limitations on the scope of what may be claimed, but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

It should be noted that references to "front," "rear," "upper," "top," "bottom," "base," and "lower" in this description are merely used to identify the various elements as they are oriented in the Figures. These terms are not meant to limit the element which they describe, as the various elements may be oriented differently in various temperature controlled cases.

Further, for purposes of this disclosure, the term "coupled" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

It is important to note that the construction and arrangement of the system shown in the various example implementations is illustrative only and not restrictive in character. All changes and modifications that come within the spirit and/or scope of the described implementations are desired to be protected. It should be understood that some features may not be necessary and implementations lacking the various features may be contemplated as within the scope of the application, the scope being defined by the claims that follow. When the language "at least a portion" and/or "a portion" is used the item can include a portion and/or the entire item unless specifically stated to the contrary.

What is claimed:

1. A cylinder head comprising:

an upper water jacket;

a lower water jacket;

a drilled valve bridge passage coupled to the lower water jacket; and a drilled water jacket connector coupled to the upper water jacket and the drilled valve bridge passage, the drilled water jacket connector fluidly joining the upper water jacket with the drilled valve bridge passage and the drilled valve bridge passage fluidly joining the drilled water jacket connector with the lower water jacket, such that the upper water jacket is coupled to the lower water jacket through the drilled valve bridge passage and the drilled water jacket connector;

wherein the drilled valve bridge passage extends into the cylinder head beyond the drilled water jacket connector; and wherein the upper water jacket and the lower water jacket are contained within the cylinder head.

2. The cylinder head of claim 1, further comprising:

a combustion face;

a top face opposite the combustion face; and an injector bore extending from the top face to the combustion face along a first central axis, wherein the drilled water jacket connector extends along a second central axis, the second central axis parallel to the first central axis.

3. The cylinder head of claim 2, wherein the drilled valve bridge passage extends along a third central axis, the third central axis perpendicular to the first central axis.

4. The cylinder head of claim 2, wherein the drilled valve bridge passage extends along a third central axis, the third central axis parallel to combustion face.

5. The cylinder head of claim 2, wherein the injector bore defines an injector seat, and wherein the drilled valve bridge passage extends closer to the injector seat than the drilled water jacket connector.

6. A method, comprising:

providing a cast cylinder head, comprising:

a combustion face, a top face opposite the combustion face, a first lateral face, a second lateral face opposite the first lateral face, an upper water jacket, a lower water jacket, and an injector bore extending from the top face to the combustion face along a first central axis;

drilling a first bore into the cylinder head from the cylinder head face through the upper water jacket so as to define a water jacket connector; and drilling a second bore into the cylinder head from the first lateral face, through the lower water jacket, and into the first bore so as to define a valve bridge passage, the water jacket connector fluidly joining the upper water jacket with the valve bridge passage and the valve bridge passage fluidly joining the water jacket connector with the lower water jacket.

7. The method of claim 6, wherein the first bore extends along a second central axis, the second central axis parallel to the first central axis.

8. The method of claim 6, wherein the second bore extends along a third central axis, the third central axis perpendicular to the first central axis.

9. The method of claim 6, wherein the second bore extends through the first bore towards an injector seat defined by the injector bore.

10. The method of claim 6, wherein the upper and lower water jackets are fluidly coupled via the water jacket connector and the valve bridge passage.

11. The method of claim 6, wherein the water jacket connector is in fluid communication with each of the upper water jacket and the valve bridge passage, and wherein the valve bridge passage is in fluid communication with the lower water jacket.

* * * * *